US009376280B2

(12) United States Patent
Page et al.

(10) Patent No.: US 9,376,280 B2
(45) Date of Patent: Jun. 28, 2016

(54) APPARATUS AND METHODS FOR DISPENSING CUSHIONING WRAP MATERIAL

(71) Applicant: Ranpak Corp., Concord Township, OH (US)

(72) Inventors: Brandon Cadette Page, Durham, NC (US); Marcelo Miller Passos, Morrisville, NC (US); Jacob Daniel Wills, Clayton, NC (US)

(73) Assignee: Ranpak Corp., Concord Township, OH (US)

( * ) Notice: Subject to any disclaimer, the term of this patent is extended or adjusted under 35 U.S.C. 154(b) by 366 days.

(21) Appl. No.: 13/943,443

(22) Filed: Jul. 16, 2013

(65) Prior Publication Data

US 2014/0027553 A1 Jan. 30, 2014

Related U.S. Application Data

(60) Provisional application No. 61/675,059, filed on Jul. 24, 2012.

(51) Int. Cl.
*B65H 16/00* (2006.01)
*B65H 23/06* (2006.01)
(Continued)

(52) U.S. Cl.
CPC ..... *B65H 16/005* (2013.01); *B65D 83/0847* (2013.01); *B65D 85/672* (2013.01);
(Continued)

(58) Field of Classification Search
CPC .. B65H 16/005; B65H 16/021; B65H 16/023; B65H 23/08; B65H 23/085; B65H 23/06; B65H 2301/4127
See application file for complete search history.

(56) References Cited

U.S. PATENT DOCUMENTS 2,848,104 A 8/1958 Schor et al.
3,302,781 A * 2/1967 Rudnick ..... B65D 85/67 206/391

(Continued)

FOREIGN PATENT DOCUMENTS

DE 40 26 895 A1 2/1992
DE 100 13 290 A1 9/2001

(Continued)

OTHER PUBLICATIONS

Notification of Transmittal of the International Search Report and the Written Opinion of the International Searching Authority, or the Declaration; International Search Report; Written Opinion of the International Searching Authority; Date of Mailing: Nov. 5, 2013; 13 pages.

*Primary Examiner* — Howard Sanders
(74) *Attorney, Agent, or Firm* — Renner, Otto, Boisselle & Sklar

(57) ABSTRACT

An apparatus for dispensing cushioning wrap material includes a box having a dispensing opening in communication with an interior of the box. A roll of interleaf material is rotatably positioned within the box such that a free end of the interleaf material can extend through the dispensing opening, and a roll of expandable sheet material in an unexpanded form is rotatably positioned within the box adjacent the first roll of sheet material such that a free end of the expandable sheet material can extend through the dispensing opening. A tensioning assembly is operably associated with the roll of expandable sheet material to control rotational resistance thereof. The interleaf material and the expandable sheet material can be concurrently pulled out of the box in abutting contact by a user and the rotational resistance of the roll of expandable sheet material causes the expandable sheet material to expand in thickness and length.

20 Claims, 16 Drawing Sheets

(51) Int. Cl.

| | |
|---|---|
| ***B65H 75/18*** | (2006.01) |
| ***B65H 16/06*** | (2006.01) |
| ***B65D 83/08*** | (2006.01) |
| ***B65D 85/672*** | (2006.01) |
| *B65H 16/02* | (2006.01) |
| *B65H 23/08* | (2006.01) |

(52) U.S. Cl.

CPC ..... *B65H16/021* (2013.01); *B65H 16/06* (2013.01); *B65H 23/06* (2013.01); *B65H 75/185* (2013.01); *B65H 16/023* (2013.01); *B65H 23/08* (2013.01); *B65H 2301/4127* (2013.01); *B65H 2301/5124* (2013.01); *B65H 2701/1716* (2013.01); *B65H 2701/1944* (2013.01)

(56) References Cited

U.S. PATENT DOCUMENTS

| | | | | |
|---|---|---|---|---|
| 5,538,778 | A | 7/1996 | Hurwitz et al. | |
| 5,667,871 | A | 9/1997 | Goodrich et al. | |
| 5,688,578 | A | 11/1997 | Goodrich | |
| 5,782,735 | A | 7/1998 | Goodrich et al. | |
| 2011/0309125 | A1 | 12/2011 | Kuchar et al. | |
| 2015/0165717 | A1* | 6/2015 | Page | B31D 5/0065 242/594.6 |

FOREIGN PATENT DOCUMENTS

| | | |
|---|---|---|
| FR | 2 367 012 | 5/1978 |
| WO | WO 2009/014110 A1 | 1/2009 |

* cited by examiner

APPARATUS AND METHODS FOR DISPENSING CUSHIONING WRAP MATERIAL

RELATED APPLICATION

This application claims the benefit of and priority to U.S. Provisional Patent Application No. 61/675,059 filed Jul. 24, 2012, the disclosure of which is incorporated herein by reference as if set forth in its entirety.

FIELD OF THE INVENTION

The present invention relates generally to packing materials and, more particularly, to packing materials for wrapping articles.

BACKGROUND

When shipping an article from one location to another, the article is typically placed in a container along with protective packaging material to fill the voids about the article and to cushion the article during the shipping process. A common protective packaging material is a cellular foam polystyrene (e.g., STYROFOAM®, The Dow Chemical Corporation, Midland, Mich.) product having a peanut shape, and commonly referred to as "packing peanuts." However, the performance and ecological disadvantages of plastic packing peanuts as a void fill material is well known. The plastic material is not easily biodegradable when in a landfill and, although the plastic material can be recycled through reuse, such recycling programs have met with limited success. Moreover, articles within a package and surrounded by plastic packing peanuts may migrate within the package. Thus, an article centered within a box when packaged, may move to a side wall of the shipping container when transported, which may lead to damage to the article during shipment.

While a variety of products have been designed to provide a void fill substitute for plastic packing peanuts, each of the products has drawbacks. For example, starch products have been used, but tend to be excessively dusty and frangible. Products made from corn husks and other vegetation, are prone to attracting vermin, rodents, and the like.

Bubble wrap is a plastic packaging product that consists of small spheres of air bubbles. Unfortunately, bubble wrap has many negative aspects. For example, the polymer film used in bubble wrap is considered ecologically toxic because it can take hundreds of years to disintegrate in landfills. In addition, because of the air bubbles, bubble wrap is bulky and can cause storage problems.

Slit sheet paper packing material is an alternative, ecologically-friendly packing material that increases in thickness when stretched. This stretching and increase in thickness of the slit sheet paper packing material is referred to as expansion. Slit sheet paper packing material typically includes a durable paper with consecutive rows of slits cut into the paper. The thickness of the slit sheet paper packing material can increase by an order of magnitude, or more, relative to its original thickness, when stretched. This increased thickness allows the expanded material to serve as a protective cushioning wrap material for articles. Slit sheet paper packing material, and the manufacturing thereof, are described in greater detail in U.S. Pat. Nos. 5,667,871 and 5,688,578, the disclosures of which are incorporated herein by reference in their entireties.

Typically, a cushion wrap material formed with expanded slit sheet packing material includes a lightweight tissue paper that acts as a separator sheet between layers of the expanded material. The tissue paper prevents openings in the expanded paper from becoming undesirably interlocked.

Traditionally, an electric powered machine is used to expand and dispense slit sheet packing material for an operator to wrap around an object. In operation, the slit sheet packing material is transformed from a thin, unexpanded layer to an expanded form inside of the machine and dispensed from the front of the machine with the unexpanded separator sheet. Unfortunately, the size of these dispensing machines typically requires a large amount of table space and vertical space above the table. In addition, the weight of these dispensing machines typically prohibits the machine from being easily moved, even over short distances. Moreover, the requirement that the dispensing machine be located near a power outlet can limit the possible places that the dispensing machine can be located or require long power cords.

U.S. Patent Application Publication No. 2011/0309125 describes a dispensing mechanism that deploys a roll of web material having slit cuts and expands it into a web with a cellular structure. The mechanism mounts a roll of unexpanded web material on an axle that is positioned at a first angle to a guide wheel assembly. The first angle is not perpendicular to the direction of deployment and the material moves through the guide wheel assembly longitudinally in such a way that tension is applied at a second angle to the direction of deployment. This diagonal tension causes the web material to expand and form cells. However, the guide wheels that are used to apply tension to the material only contact a small portion of the material on one side. This limited and offset contact may cause undesirable, uneven expansion of the slit sheet material.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, an apparatus for dispensing eco-friendly cushioning wrap material includes a box having a dispensing opening in communication with an interior of the box. A roll of interleaf material is rotatably positioned within the box such that a free end of the interleaf material can extend through the dispensing opening. A roll of expandable sheet material in an unexpanded form is also rotatably positioned within the box adjacent the roll of interleaf material such that a free end of the expandable sheet material can extend through the dispensing opening. A tensioning assembly is operably associated with the roll of expandable sheet material to control rotational resistance thereof.

The interleaf material and the expandable sheet material can be concurrently manually pulled out of the box in abutting contact and the rotational resistance of the roll of expandable sheet material causes the expandable sheet material to expand in thickness and length as it is pulled with the interleaf material by a user. Each roll has a width with a centerline extending orthogonal to the axial direction, and typically the rolls are located within the box such that the respective centerlines of the rolls are substantially aligned. In addition, the rolls are oriented such that their axial directions are typically substantially parallel. A width of the roll of interleaf material may be up to about 50% less than a width of the roll of expanded sheet material. However, in some embodiments, the roll of interleaf material may have a width that is substantially the same as a width of the roll of expanded sheet material. As such, embodiments of the present invention may include a roll of interleaf material with a width equal to or about 50% less than a width of a roll of expanded sheet material.

The box includes opposite front and rear walls and opposite side walls. In some embodiments, the roll of interleaf material is positioned within the box adjacent the rear wall and the roll of expandable sheet material is positioned within the box adjacent the front wall. In other embodiments, the roll of interleaf material is positioned within the box adjacent the front wall and the roll of expandable sheet material is positioned within the box adjacent the rear wall.

In some embodiments of the present invention, the apparatus includes a pair of spacers, each positioned between an end portion of the roll of interleaf material and a respective side wall such that the roll of interleaf material is centered laterally in the box between the opposite side walls and substantially centered relative to the roll of expandable sheet material.

In some embodiments, the roll of interleaf material includes an axially-extending hollow core. An elongated member having opposite end portions extends through the hollow core and each end portion of the elongated member is suspended by a respective one of the spacers.

In some embodiments of the present invention, the box includes a cover that is movable between open and closed positions. The dispensing opening is defined when the cover is in the closed position. The rolls of interleaf material and expandable sheet material can be inserted for initial use or replaced when the cover is in the open position.

In some embodiments of the present invention, the interleaf material and expandable sheet material are paper sheet materials (e.g., any type of paper, as well as non-woven fibrous sheet materials, woven fibrous sheet materials, etc.). For example, the interleaf material may be tissue paper and the expandable sheet material may be paper (e.g., kraft paper, etc.). However, various types of sheet materials may be utilized. Embodiments of the present invention are not limited to paper sheet materials. Other sheet materials including, but not limited to, polymeric materials and foil may also be utilized. The expandable sheet material may include a slit pattern which forms an array of openings (e.g., hexagonal openings, diamond-shaped openings, etc.) when the expandable sheet material is in an expanded form.

In some embodiments of the present invention, the box includes spaced-apart first and second visual indicia adjacent the dispensing opening. A distance between the first and second visual indicia corresponds to a desired width of the expandable sheet material as it is dispensed from the box in a proper expanded shape. Alternatively, the box may include a forward wall with a recessed edge portion below the dispensing opening. The recessed edge portion has a lateral width that corresponds to a desired width of the expandable sheet material as it is dispensed from the box in a proper expanded shape.

In some embodiments of the present invention, the tension assembly includes first and second support members, first and second core plugs, and a cord. The first and second support members each have an opening formed therethrough. The first support member is located proximate to a first end of the roll of expandable sheet material, and the second support member is located proximate to an opposing second end of the roll of expandable material. The first core plug includes opposite first and second end portions, and a radially outwardly directed flange adjacent the first core plug first end portion. First and second passageways are formed through the first core plug from the first end to the second end thereof. The first core plug second end portion extends through the first support member opening and into one end of the hollow core such that the first support member is positioned between a first end of the roll of expandable sheet material and the first core plug flange. The second core plug includes opposite first and second end portions, and a radially outwardly directed flange adjacent the second core plug first end portion. A third passageway is formed through the second core plug. The second core plug second end portion extends through an opening in a side wall of the housing, through the second support member opening, and into an opposite end of the hollow core such that the second support member is positioned between an opposite second end of the roll of expandable sheet material and the housing side wall. The cord extends though the hollow core section, and through the first, second, and third passageways to form a loop. The loop is configured to twist and cause the first support member to exert a compressive force on the first end of the roll of expandable sheet material in response to user rotation of the second core plug.

In other embodiments of the present invention, the tension assembly includes first and second support members, and first and second core plugs. The first and second support members each have an opening formed therethrough. The first support member is located proximate to a first end of the roll of expandable sheet material, and the second support member is located proximate to an opposing second end of the roll of expandable material. The first core plug extends through the first support member opening and into one end of the hollow core. The second core plug extends through an opening in a side wall of the housing, through the second support member opening, and into an opposite end of the hollow core. The second core plug includes an externally-threaded portion that urges the roll of expandable material towards the second support member to exert a compressive force on the second end of the roll of expandable sheet material in response to user rotation of the second core plug.

In some embodiments of the present invention, the box is a cardboard box. In other embodiments, the box is formed of wood, plastic, and/or metal.

In some embodiments of the present invention, the box is configured to allow the roll of expandable sheet material and the tensioning assembly to be inserted and removed as a unit.

In some embodiments of the present invention, the box includes at least one portion configured to be securely attached to a flat support surface.

According to other embodiments of the present invention, a dispensing system for cushioning wrap material includes a box, a removable box cover, a roll of interleaf material rotatably positioned within the box, a roll of expandable sheet material in an unexpanded form rotatably positioned within the box adjacent the first roll of interleaf material, and a tensioning assembly operably associated with the roll of expandable sheet material to control rotational resistance thereof.

The box includes a forward wall, opposite side walls, and a dispensing opening adjacent the forward wall that is in communication with an interior of the box. The roll of interleaf material is rotatably positioned within the box such that a free end of the interleaf material can extend through the dispensing opening, and the roll of expandable sheet material is rotatably positioned within the box such that a free end of the expandable sheet material can extend through the dispensing opening. The interleaf material and expandable sheet material can be concurrently manually pulled out of the box in abutting contact. The rotational resistance of the roll of expandable sheet material causes the expandable sheet material to expand in thickness and in length as it is pulled with the interleaf material by a user from the box.

A pair of spacers can be positioned within the box such that each is located between an end portion of the roll of interleaf material and a respective side wall. The spacers are configured to center the roll of interleaf material laterally in the box between the opposite side walls relative to the roll of expandable sheet material. In some embodiments, an elongated member having opposite end portions extends through the hollow core of the roll of interleaf material, and each end portion is suspended by a respective one of the spacers.

In some embodiments of the present invention, the dispensing system weighs less than twenty pounds (20 lbs) and the expandable sheet material and interleaf material on each respective roll are each at least one hundred feet (100 ft) in length. However, in other embodiments of the present invention, longer lengths of paper may be utilized. For example, the expandable sheet material can be up to about one thousand feet (1,000 ft) in length in an unexpanded form, and the interleaf material can be up to about seventeen hundred feet (1,700 ft) in length. Typically the interleaf material is about 1.67 times longer than the expandable sheet material in an unexpanded form. In some embodiments of the present invention, the dispensing system may weigh up to about fifty pounds (50 lbs).

In some embodiments of the present invention, the interleaf material is tissue paper and the expandable sheet material is kraft paper.

In some embodiments of the present invention, the box includes spaced-apart first and second visual indicia adjacent the dispensing opening. A distance between the first and second visual indicia corresponds to a desired width of the expandable sheet material as it is dispensed from the box in a proper expanded shape. In other embodiments, a forward wall of the box includes a recessed edge portion below the dispensing opening. The recessed edge portion has a lateral width that corresponds to a desired width of the expandable sheet material as it is dispensed from the box in a proper expanded shape.

According to other embodiments of the present invention, a method of dispensing cushioning wrap material from an apparatus, includes concurrently manually pulling interleaf material (e.g., tissue paper, etc.) from a first roll rotatably positioned within a portable, lightweight box and expandable sheet material in its unexpanded form (e.g., slit sheet paper, etc.) from a second roll rotatably positioned within the box while maintaining rotational resistance of the second roll such that the expandable sheet material expands to a proper expanded form in thickness and in length. The rotational resistance of the second roll of expandable sheet material can be adjusted via a tensioning assembly operably associated with the second roll and the housing such the expandable sheet material in its expanded form has a desired width.

According to other embodiments of the present invention, a kit for replenishing an apparatus for dispensing cushioning wrap material includes a roll of interleaf material, such as tissue paper, and a roll of expandable sheet material in its unexpanded form, such as slit sheet paper. A width of the roll of interleaf material may be up to about 50% less than a width of the roll of expanded sheet material. However, in some embodiments, the roll of interleaf material may have a width that is substantially the same as a width of the roll of expanded sheet material. As such, embodiments of the present invention may include a roll of interleaf material with a width equal to or about 50% less than a width of a roll of expanded sheet material. A tensioning assembly is operably associated with the roll of expandable sheet material to control rotational resistance thereof. The rotational resistance causes the expandable sheet material to expand as it is pulled concurrently with the interleaf material by a user from the box.

According to other embodiments of the present invention, a roll of expandable sheet material includes an axially-extending hollow core around which the roll of expandable sheet material is held. A first core plug extends into one end of the hollow core, and a second core plug extends through into an opposite end of the hollow core. A cord extends though the hollow core and is secured to the first and second core plugs to form a loop. The loop is configured to twist and cause the first core plug to exert a compressive force on the first end of the roll of expandable sheet material in response to user rotation of the second core plug. In some embodiments, the expandable sheet material is kraft paper. In some embodiments, the expandable sheet material has a slit pattern which forms an array of openings (e.g., hexagonal openings, diamond-shaped openings, etc.) when the expandable sheet material is in an expanded form.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1A:
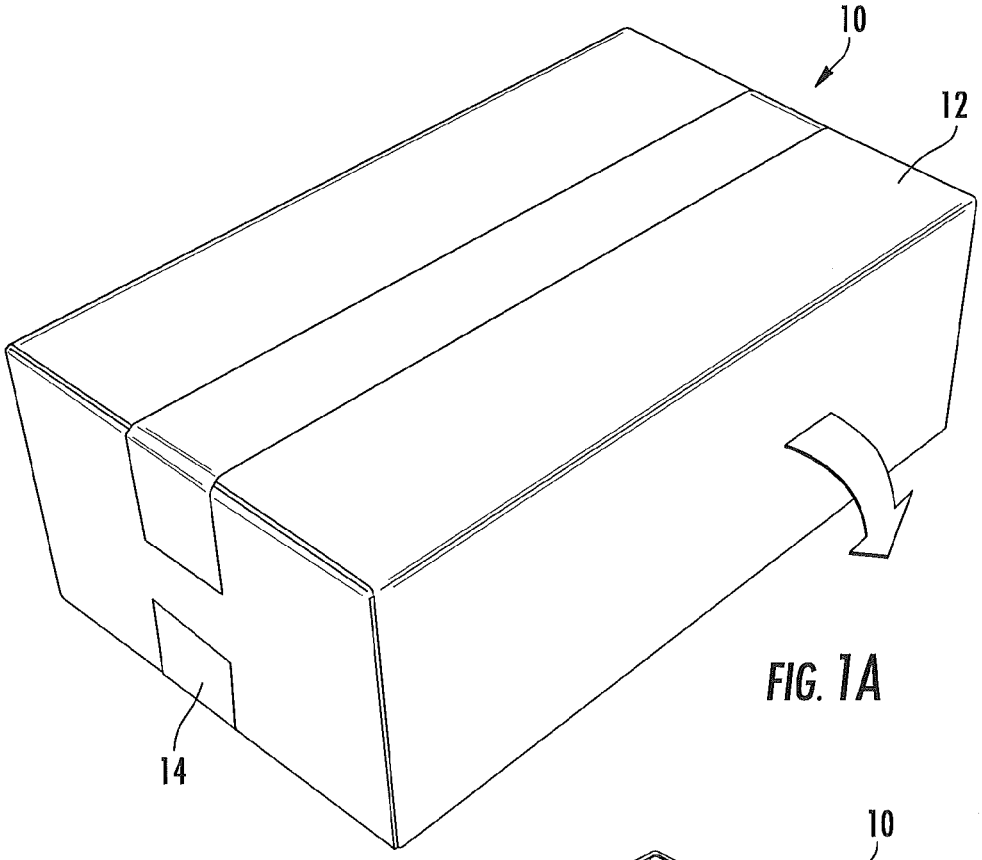
FIG. 1A is a top perspective view of a dispensing apparatus for cushioning wrap material with a shipping cover attached thereto, according to some embodiments of the present invention.

The present invention now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary by +/− twenty percent (20%).

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Figure 1B:
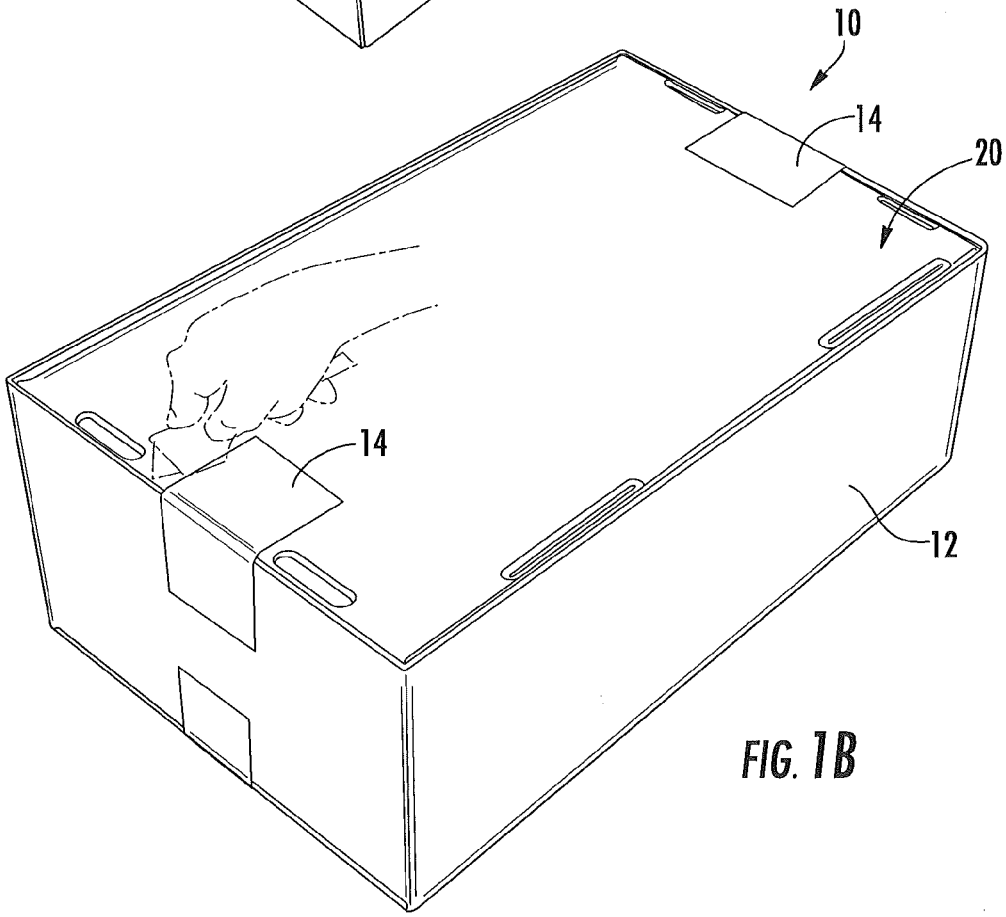
FIG. 1B is a bottom perspective view of the dispensing apparatus of FIG. 1A illustrating a user cutting tape that secures the shipping cover to the apparatus.
Figure 1C:
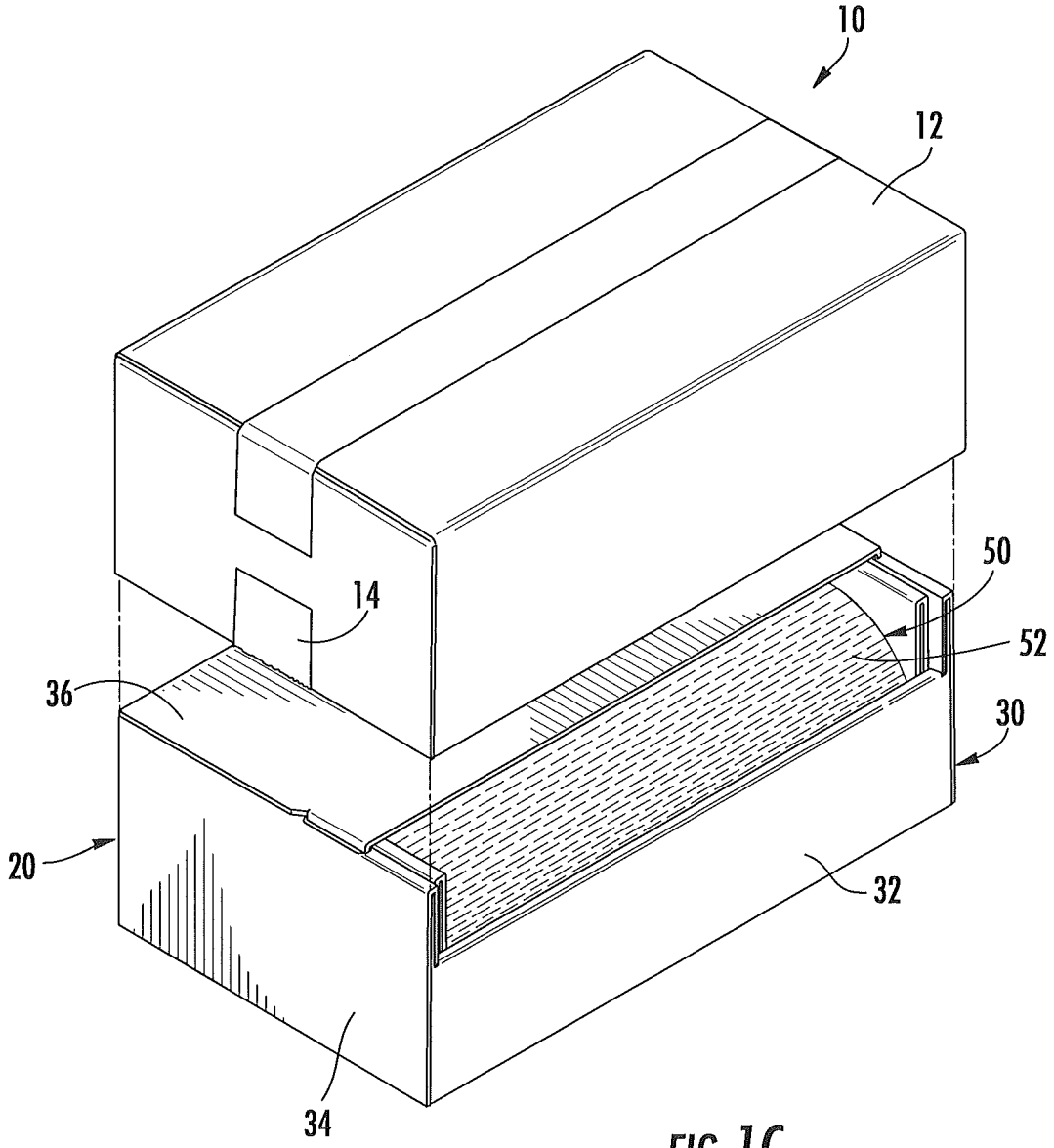
FIG. 1C is a top, front perspective view of the dispensing apparatus of FIG. 1A with the shipping cover being removed therefrom.
Figure 8:
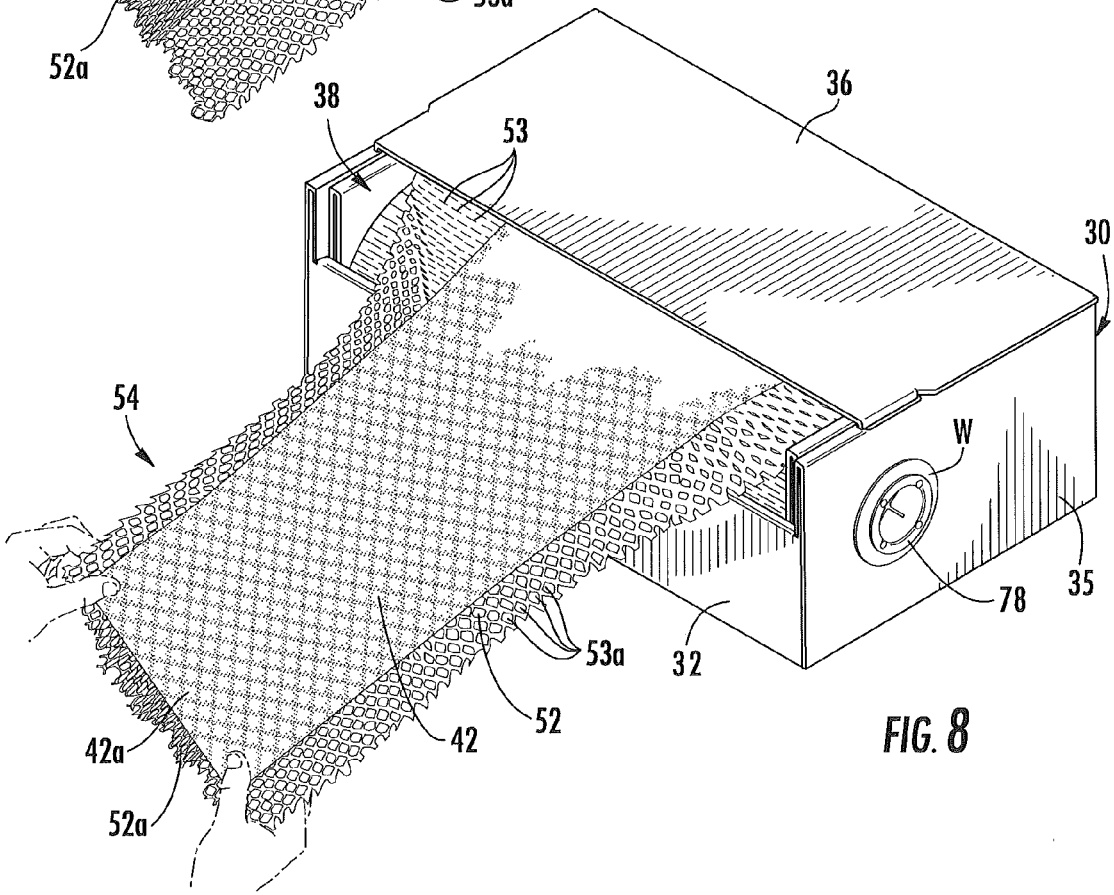
FIG. 8 is a top, front perspective of the apparatus of FIG. 2 illustrating a user concurrently pulling the interleaf material and the expandable sheet material from the apparatus to form a cushioning wrap material.

Referring initially to FIGS. 1A-1C, a lightweight, easily shippable dispensing system 10 for cushioning wrap material 54 (FIG. 8), such as environmentally friendly material, is illustrated. The system 10 typically weighs less than twenty pounds and dispenses cushioning wrap material 54 (FIG. 8). The cushioning wrap material 54 can be provided in any lengths, typically with sufficient length to provide between about one hundred feet and about one thousand feet (100 ft-1,000 ft), e.g., about seven hundred fifty feet (750 ft). For example, the expandable sheet material can be up to about one thousand feet (1,000 ft) in length in an unexpanded form, and the interleaf material can be up to about seventeen hundred feet (1,700 ft) in length. Typically the interleaf material is about 1.67 times longer than the expandable sheet material in an unexpanded form. In some embodiments of the present invention, the dispensing system may weigh up to about fifty pounds (50 lbs).

The dispensing system 10 includes an apparatus 20 for dispensing cushioning wrap material. The system 10 can include a removable cover 12 utilized in shipping the dispensing apparatus 20. In some embodiments of the present invention, all components of the dispensing system 10 can be recyclable, biodegradable, and compostable, including the cushioning wrap material. In FIGS. 1A and 1B, the shipping cover 12 is secured to the dispensing apparatus 20 via shipping tape 14, although other ways of attaching the shipping cover 12 to the box 20 may be utilized. Prior to use, a user can cut the shipping tape 14 (FIG. 1B) and remove the shipping cover 12 (FIG. 1C) from the dispensing apparatus 20.

Figure 2:
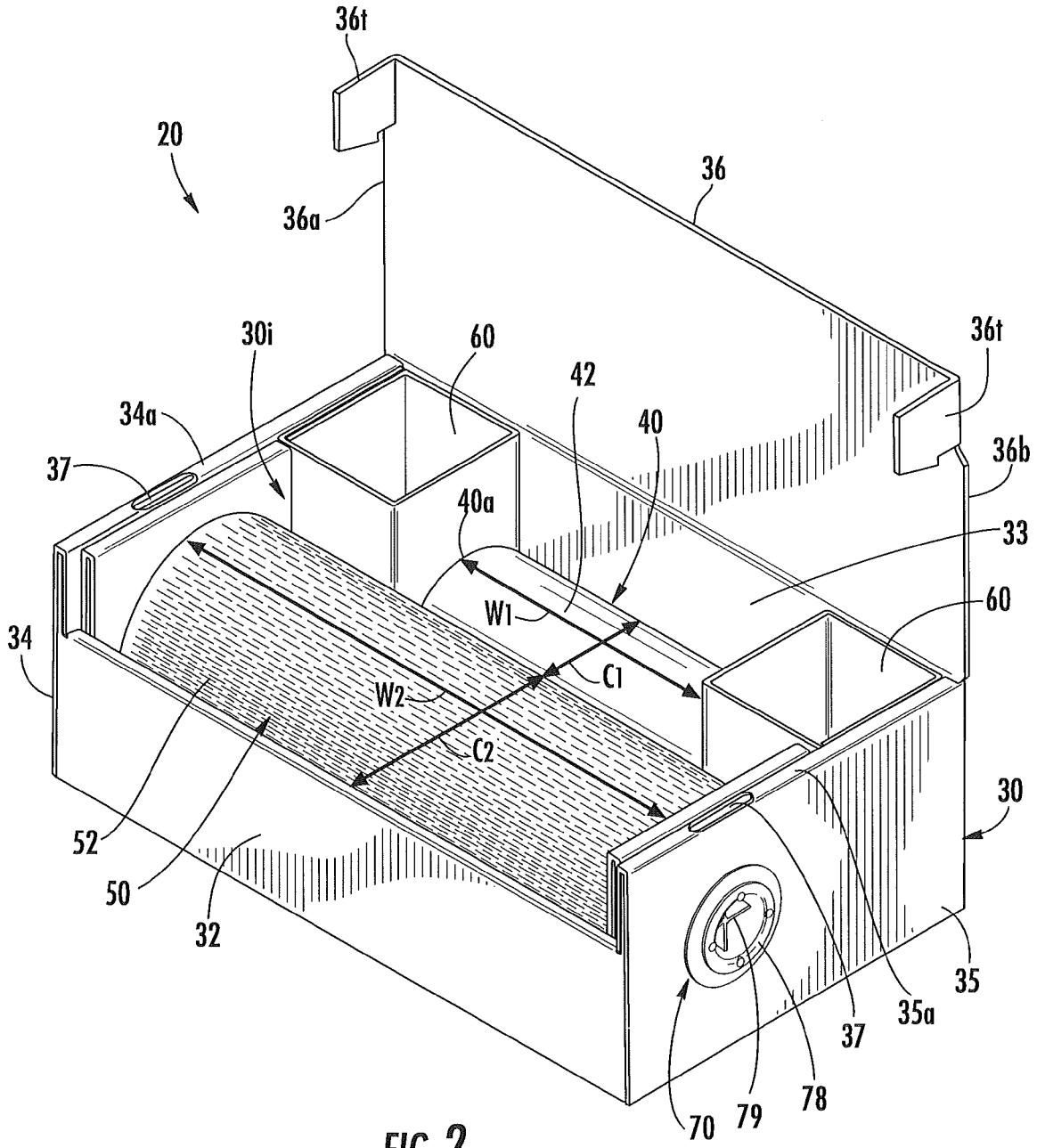
FIG. 2 is a top, front perspective view of the dispensing apparatus of FIGS. 1A-1C with a cover in an open position and illustrating a roll of interleaf material and an adjacent roll of expandable sheet material therewithin, according to some embodiments of the present invention.

The dispensing apparatus 20 is illustrated in FIG. 2 and includes a box 30, such as a cardboard box, having a bottom wall 31, opposite front and rear walls 32, 33, and opposite side walls 34, 35 that define an interior 30*i*. The box 30 also includes a movable cover 36 that is movable between open (FIG. 2) and closed positions (FIGS. 7-10B). As shown in FIG. 2, the cover 36 includes a pair of tabs 36*t* along respective opposite side edge portions 36*a*, 36*b*. Each tab 36*t* can be configured to matably engage with a respective slot 37 in an upper edge portion 34*a*, 35*a* of each respective side wall 34, 35 to maintain the cover 36 in the closed position, as would be understood by one skilled in the art. A dispensing opening 38 adjacent the front wall 32 that is in communication with the box interior 30*i* is defined when the cover 36 is in the closed position (FIGS. 7-10B). In other embodiments, the dispensing opening 38 may be located adjacent a lower portion of the front wall 32, for example, between the front wall 32 and the bottom wall 31.

Figure 3:
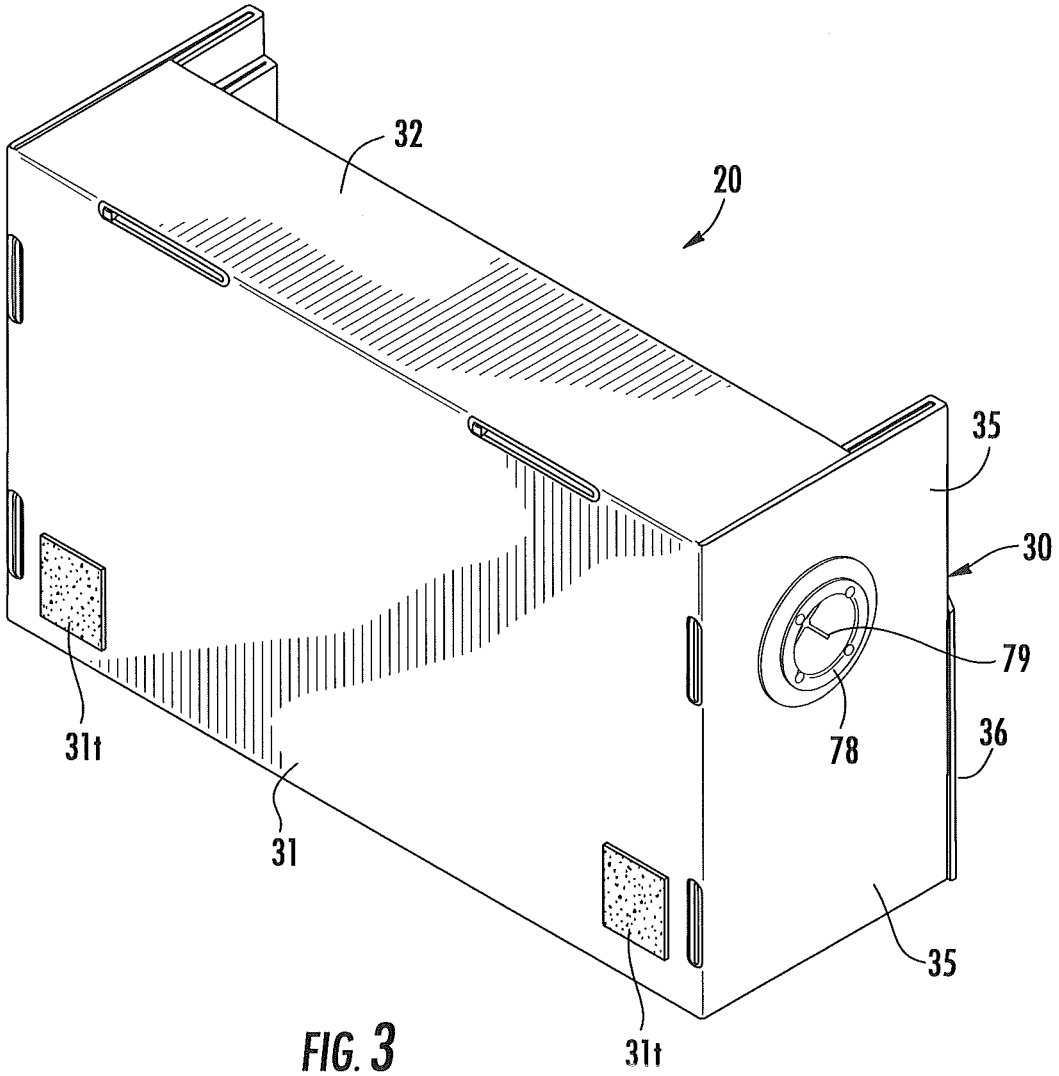
FIG. 3 is a bottom perspective view of the dispensing apparatus of FIG. 2 illustrating adhesive tape attached on the bottom wall for securing the apparatus to a support surface, according to some embodiments of the present invention.
Figure 4:
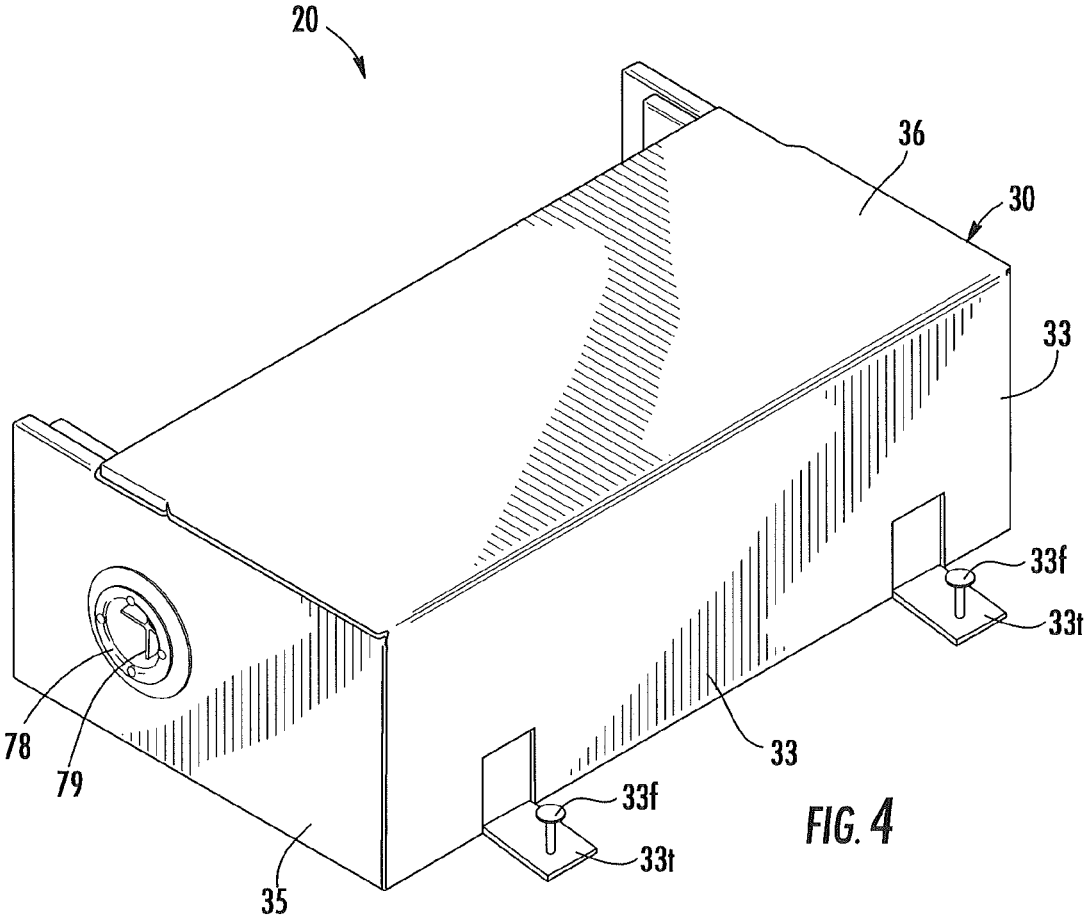
FIG. 4 is a top, rear perspective view of the dispensing apparatus of FIG. 2 illustrating tabs extending from the rear wall that can be used to secure the apparatus to a support surface, according to some embodiments of the present invention.

In some embodiments, the box 30 may be attached to a flat support surface prior to use in order to inhibit motion of the box during dispensing of the cushioning wrap material 54 (FIG. 8). Various ways of securing the box 30 to a support surface can be utilized. For example, as illustrated in FIG. 3, adhesive tape 31*t* may be applied to one or more locations along the bottom wall 31 such that the box 30 can be adhesively secured to a support surface. In other embodiments, as shown in FIG. 4, the box 30 may include spaced-apart tabs 33*t* in rear wall 33 (or in other walls) that can be folded down and secured to a support surface via a fastener 33*f*, such as a nail, tack, screw, etc. In other embodiments, a rigid, fixed object can be utilized as a physical barrier to prevent the box 30 from moving forward during dispensing of the cushion wrap material. For example, a piece of wood or metal can be mounted to a support surface in front of the box 30, or the box 30 can be held in a channel to maintain its static position.

Figure 5:
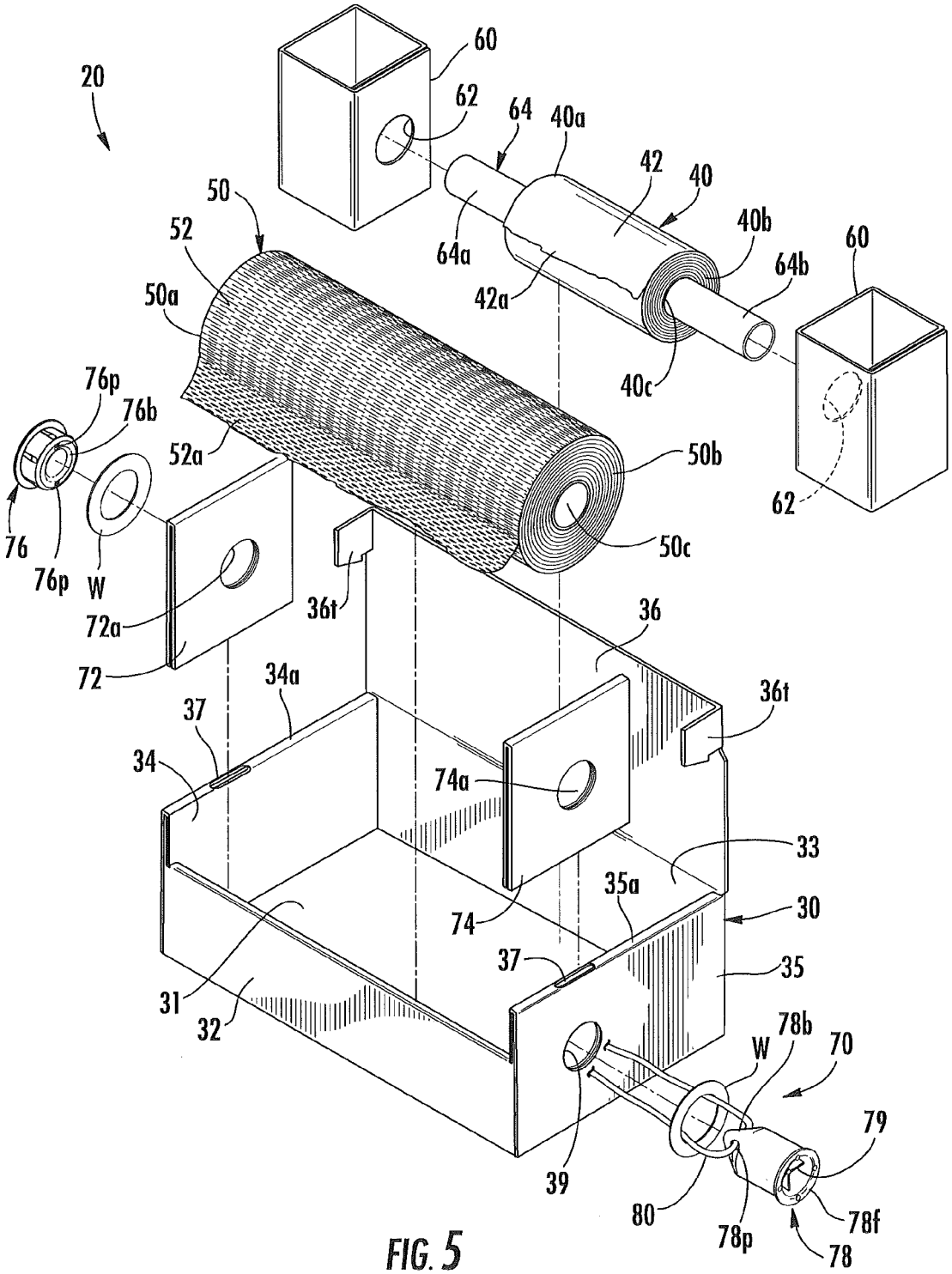
FIG. 5 is an exploded perspective view of the dispensing apparatus of FIG. 2.
Figure 7:
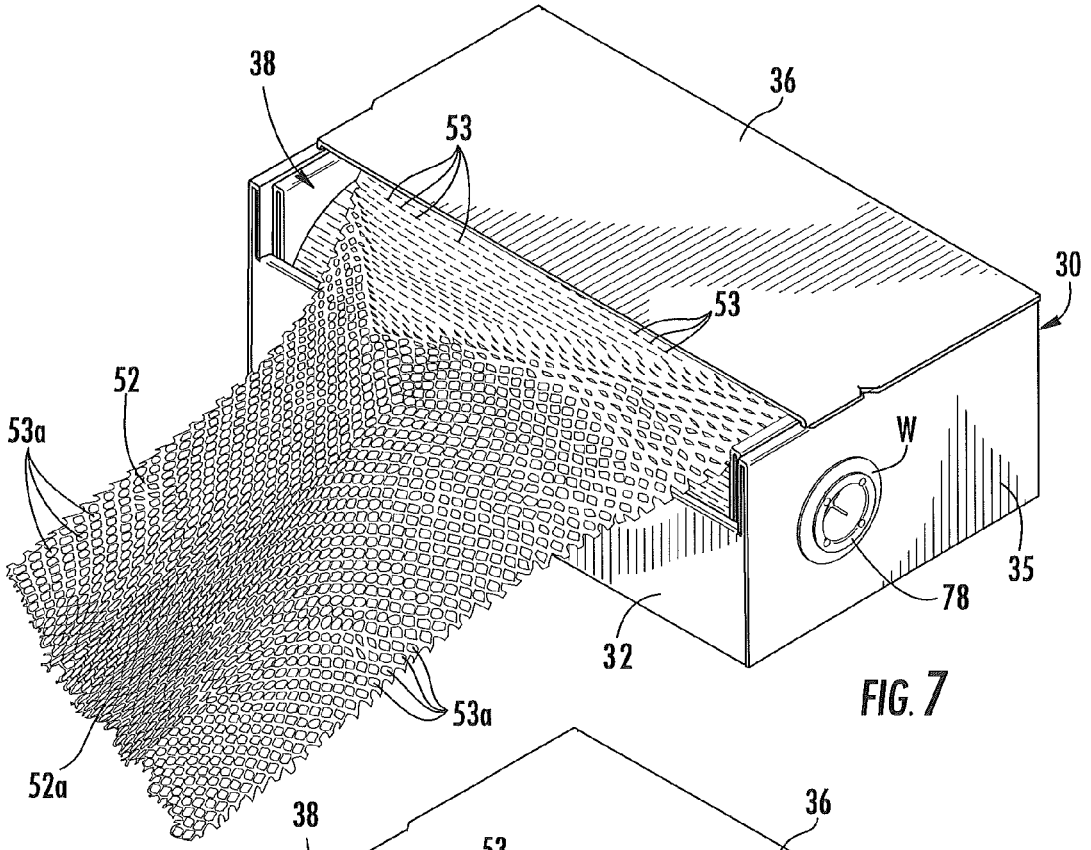
FIG. 7 is a top, front perspective of the apparatus of FIG. 2 illustrating the expandable sheet material pulled from the apparatus such that the material is stretched to an expanded form.

As shown in FIG. 5, for example, a roll 40 of interleaf material 42 is rotatably positioned within the box 30, such that a free end 42*a* of the interleaf material 42 can extend through the dispensing opening 38 (FIG. 8). A roll 50 of expandable sheet material 52 in an unexpanded form is rotatably positioned within the box 30 adjacent the roll 40 of interleaf material 42 and such that a free end 52*a* of the expandable sheet material 52 can extend through the dispensing opening 38 (FIGS. 7-8). Typically, the interleaf material 42 and expandable sheet material 52 are paper sheet materials, such as non-woven fibrous sheet materials. For example, an exemplary interleaf material 42 is light weight paper, such as tissue paper, and an exemplary expandable sheet material 52 is kraft paper. However, embodiments of the present invention are not limited to kraft paper or to non-woven fibrous materials. Various types of sheet materials may be utilized. The interleaf material 42 and the expandable sheet material 52 may have different colors, as well as different surface texturing, thickness and materials.

As shown in FIG. 7, the expandable sheet material 52 includes a pattern of slits 53 which form an array of openings 53*a* when the expandable sheet material is stretched to an expanded form. Various slit patterns may be utilized to produce openings of various shapes and configurations. An exemplary slit pattern forms an array of openings (e.g., hexagonal openings, diamond-shaped openings, etc.) when the expandable sheet material 52 is stretched to an expanded form.

In the illustrated embodiment of FIG. 2, the roll 40 of interleaf material 42 is positioned within the box 30 adjacent the rear wall 33 and the roll 50 of expandable sheet material 52 is positioned within the box 30 adjacent the front wall 32. However, in other embodiments and as illustrated in FIG. 9C, the roll 40 of interleaf material 42 may be positioned within the box 30 adjacent the front wall 32 and the roll 50 of expandable sheet material 52 may be positioned within the box 30 adjacent the rear wall 33. The rolls 40, 50 can reside snugly close together inside the box interior 30*i*.

Figure 9A:
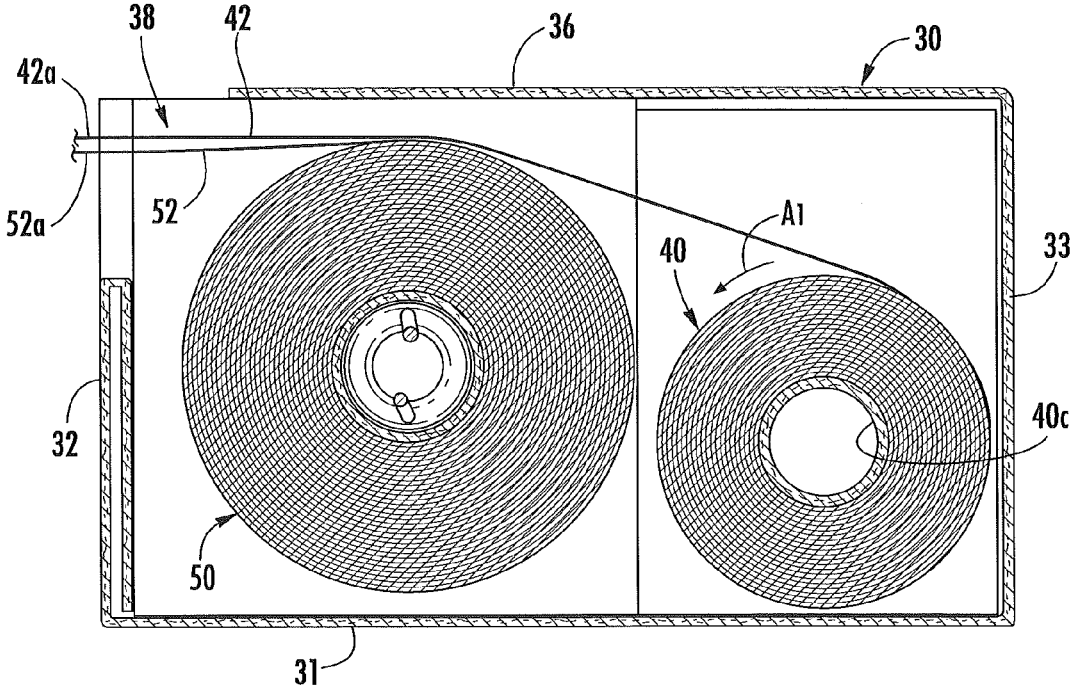
FIGS. 9A-9B are side section views of the apparatus of FIG. 2 illustrating the roll of interleaf material adjacent a rear wall of the apparatus and the roll of expandable sheet material adjacent a front wall of the apparatus, according to some embodiments of the present invention.
Figure 9B:
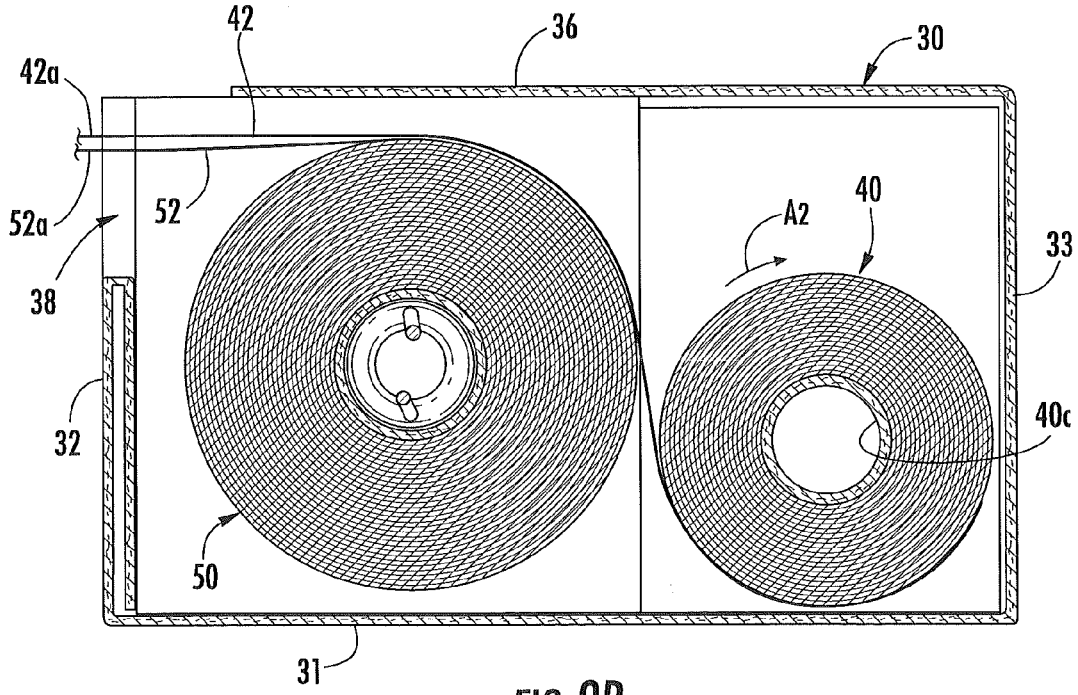
Figure 9C:
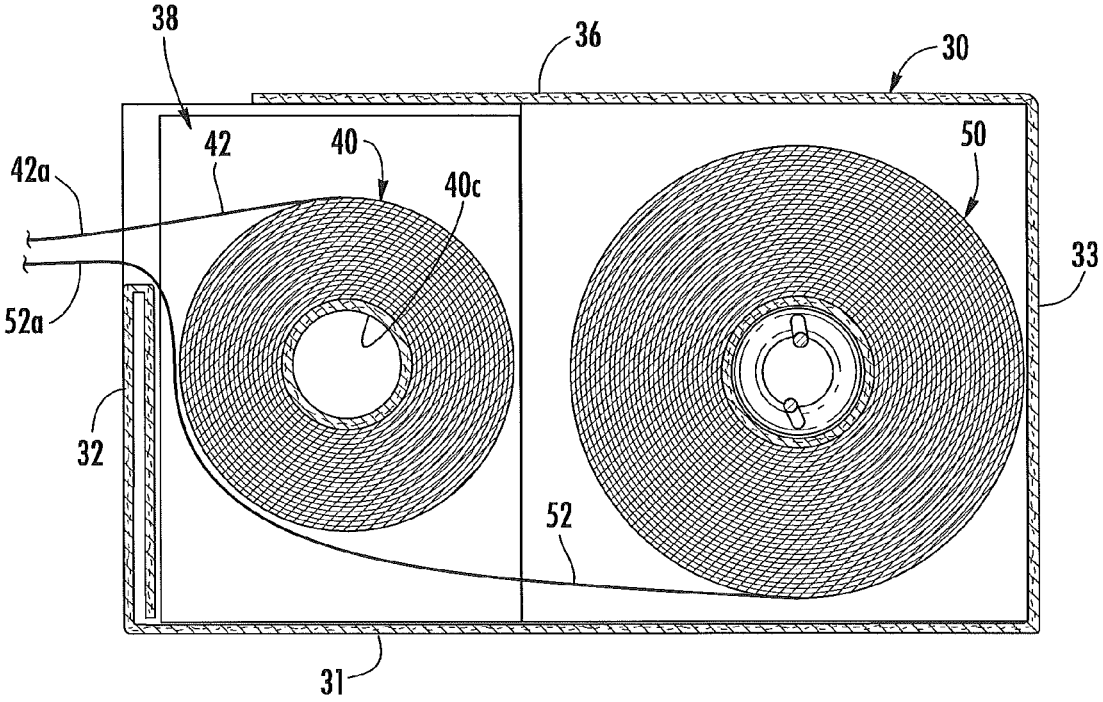
FIG. 9C is a side section view of the apparatus of FIG. 2 illustrating the roll of interleaf material adjacent a front wall of the apparatus and the roll of expandable sheet material adjacent a rear wall of the apparatus, according to some embodiments of the present invention.

In addition, the roll 40 of interleaf material 42 may be positioned within the box 30 such that when the interleaf material is pulled from the box by a user, the roll 40 rotates in a counter-clockwise direction, indicated by arrow $A_1$, as illustrated in FIG. 9A. In other embodiments, the roll 40 of interleaf material 42 may be positioned within the box 30 such that when the interleaf material 42 is pulled from the box 30 by a user, the roll 40 rotates in a clockwise direction, indicated by arrow $A_2$, as illustrated in FIG. 9B.

Figure 6A:
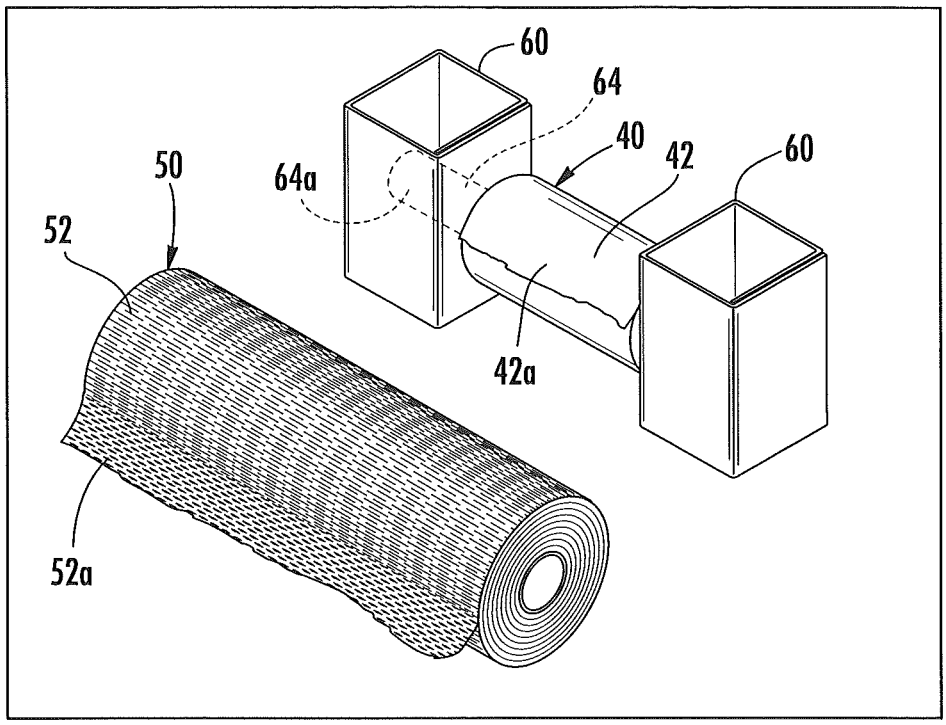
FIG. 6A is a perspective view of a roll of expandable sheet material and a roll of interleaf material suspended by a pair of spacers, according to some embodiments of the present invention.
Figure 6B:
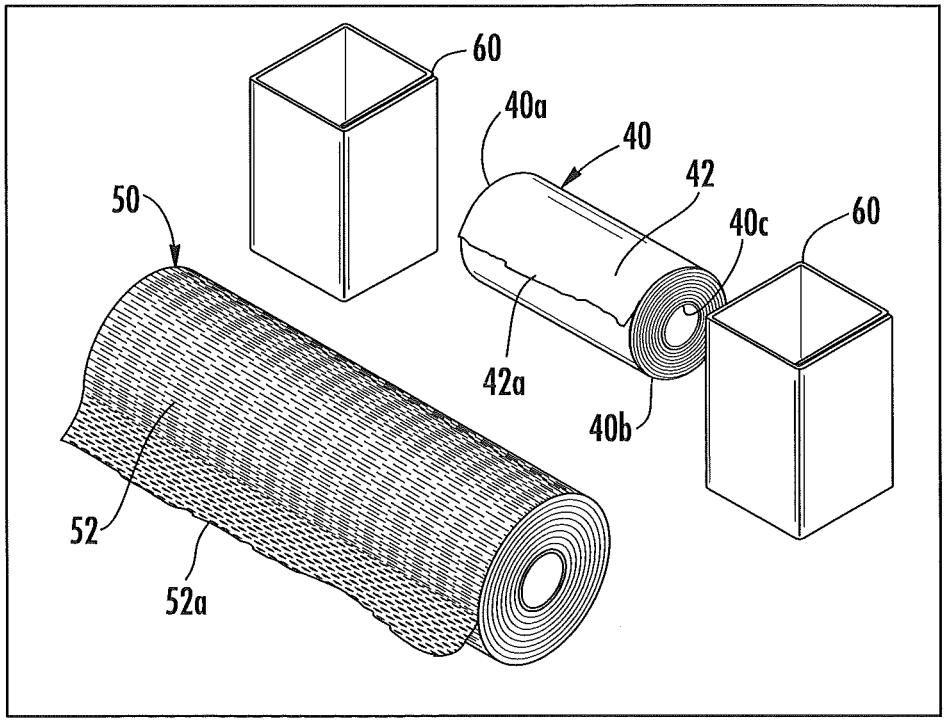
FIG. 6B is a perspective view of a roll of expandable sheet material and a roll of interleaf material with another embodiment of a pair of spacers, according to some embodiments of the present invention.

In the illustrated embodiment of FIGS. 2 and 6B, a pair of spacers 60 are positioned within the box 30 such that each spacer 60 is located between an end portion 40*a*, 40*b* of the roll 40 of interleaf material 42 and a respective side wall 34, 35. The spacers 60 are configured to center the roll 40 of interleaf material 42 laterally in the box 30 between the opposite side walls 34, 35 relative to the roll 50 of expandable sheet material 52. As such, the rolls 40, 50 are located within the box such that respective centerlines $C_1$, $C_2$ of the rolls 40, 50 are substantially aligned. In some embodiments, the spacers 60 can be integrated into the box design rather than provided as separate components.

As illustrated in FIGS. 2, 6B, and 9A-9B, in some embodiments, the roll 40 of interleaf material 42 is supported by the bottom wall 31 of the box 30. In other embodiments, as illustrated in FIGS. 5, 6A, and 9C, the roll 40 of interleaf material 42 is suspended above the bottom wall 31 of the box 30. For example, as illustrated in FIGS. 5 and 6A, an elongated support member 64 having opposite end portions 64*a*, 64*b* extends through the hollow core 40*c* of the roll 40 of interleaf material 42. Each end portion 64*a*, 64*b* of the elongated member 64 resides in a respective opening 62 in each spacer 60. As such, the elongated member 64 and roll 40 of interleaf material 42 is suspended within the box 30, typically between about one inch and five inches (1"-5") above the bottom wall 31.

Figure 11:
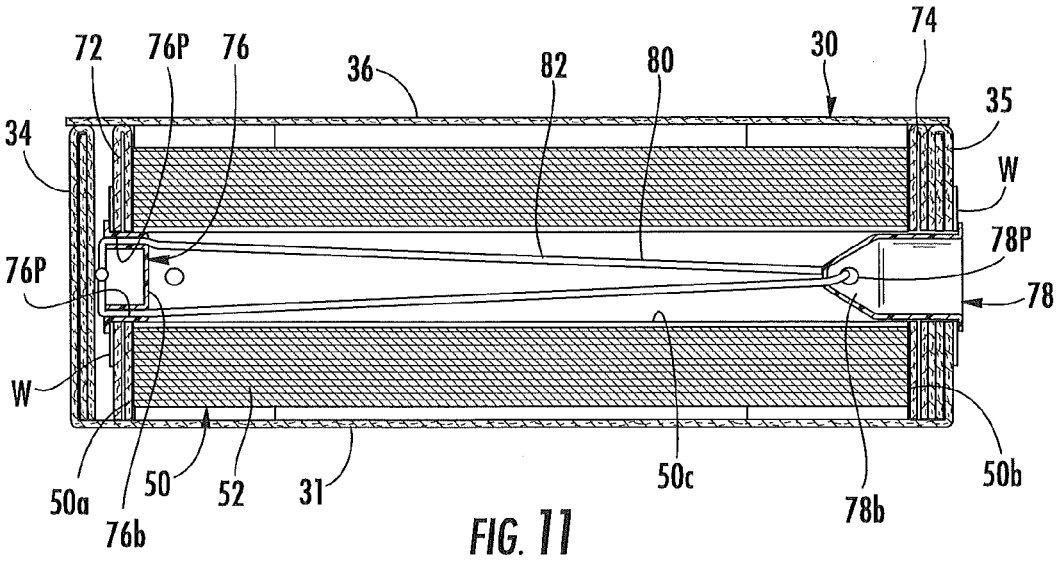
FIG. 11 is a front sectional view of an apparatus illustrating a tension assembly for adjusting rotational resistance of the roll of expandable material, according to some embodiments of the present invention.

The dispensing apparatus can include a tensioning assembly 70 that is operably associated with the roll 50 of expandable sheet material 52 to control rotational resistance of the roll 50 as a user pulls the expandable material 52 from the box 30. This rotational resistance causes the expandable material to expand in thickness and length, as will be described below. The tension assembly 70, according to some embodiments of the present invention, is illustrated in FIGS. 5 and 11 and includes first and second support members 72, 74, first and second core plugs 76, 78, and a cord 80. The first and second support members 72, 74 each have an opening 72*a*, 74*a* formed therethrough. The first support member 72 is located proximate to a first end 50*a* of the roll 50 of expandable sheet material 52, and the second support member 74 is located proximate to an opposing second end 50*b* of the roll 50 of expandable material 52. The first and second support members 72, 74 can be rigid or semi-rigid flat members such as cardboard members that abut or reside closely spaced to the respective box side walls 34, 35.

Figure 13:
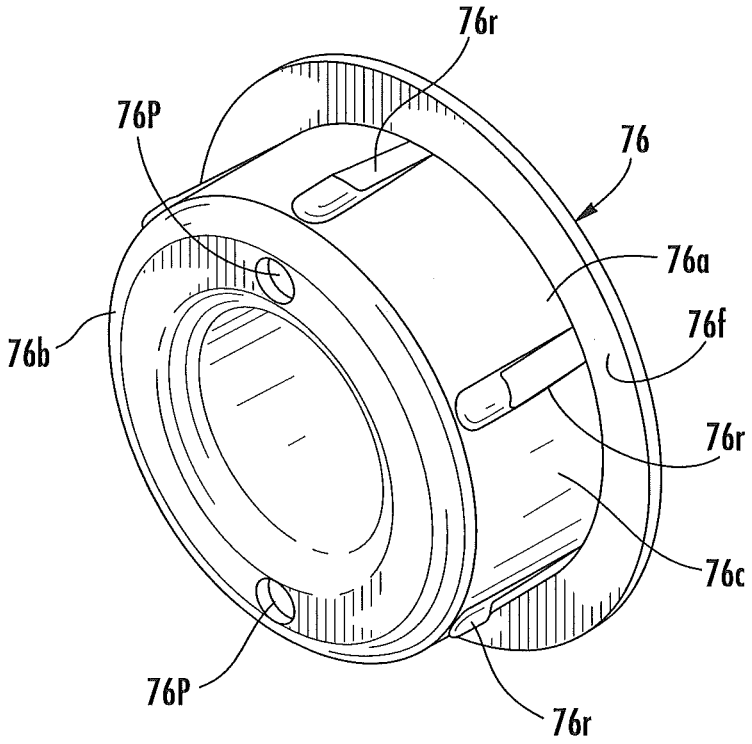
FIGS. 13 and 14 are perspective views of the first and second core plugs, respectively, that can be utilized in the tension assembly of FIG. 11.

The first core plug 76 includes opposite first and second end portions 76*a*, 76*b*, as illustrated in FIG. 13. A radially outwardly directed flange 76*f* is positioned adjacent the first end portion 76*a*. First and second passageways 76*p* are formed through the first core plug 76 from the first end 76*a* to the second end 76*b* thereof. The first core plug 76 includes a generally cylindrical intermediate portion 76*c* between the first and second end portions 76*a*, 76*b*. A plurality of circumferentially spaced-apart ribs 76*r* extend outwardly from the intermediate portion 76*c*, as illustrated in FIG. 13. Ribs 76*r* are configured to frictionally engage a portion of the hollow core 50*c* of roll 50 when the first core plug 76 is inserted therewithin.

Figure 14:
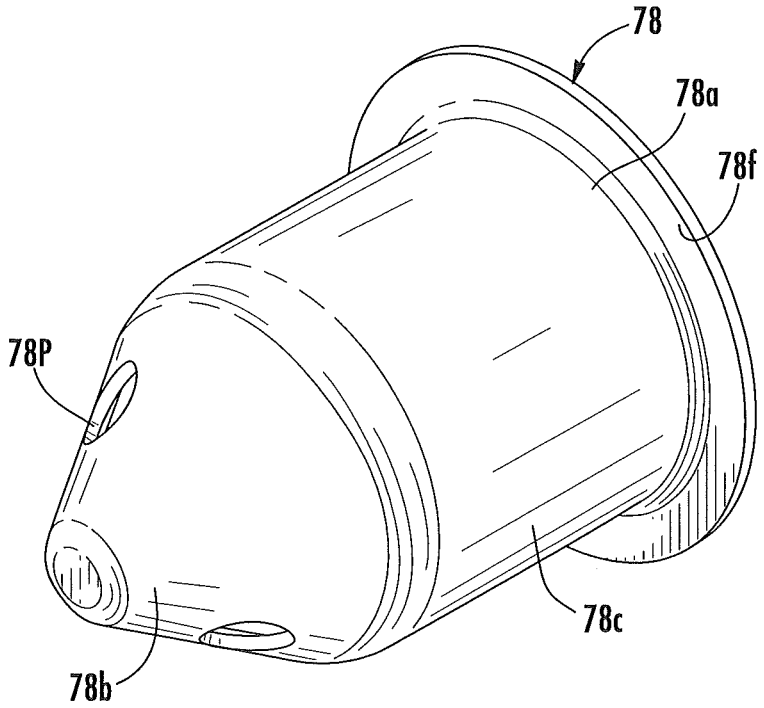

The second core plug 78 includes opposite first and second end portions 78*a*, 78*b*, as illustrated in FIG. 14. A radially outwardly directed flange 78*f* is positioned adjacent the first end portion 78*a*. A passageway 78*p* is formed through the second end portion 78*b*, as illustrated. The second core plug 78 includes a generally cylindrical intermediate portion 78*c* between the first and second end portions 78*a*, 78*b*. The second end portion 78*b* can taper to a more narrow end from the cylindrical portion 78*c*.

Referring to FIGS. 5 and 11, the second end portion 76*b* of the first core plug 76 extends through the first support member opening 72*a* and into one end of the hollow core 50*c* such that the first support member 72 is positioned between a first end 50*a* of the roll 50 of expandable sheet material 52 and the first core plug flange 76*f*. In the illustrated embodiment, a washer W can also be utilized and is positioned between the first support member 72 and the first core plug flange 76*r*. The second core plug second end portion 78*b* extends through an opening 39 in side wall 35 of the box 30, through the second support member opening 74*a*, and into an opposite end of the hollow core 50*c* such that the second support member 74 is positioned between an opposite second end 50*b* of the roll 50 of expandable sheet material 52 and side wall 35. In the illustrated embodiment, a washer W can also be utilized and is positioned between the side wall 35 and the second core plug flange 78*f*.

The cord 80, which may be a rope, string, wire, etc., extends though the hollow core 50*c* of roll 50, through the two passageways 76*p* in the first core plug 76, and through the passageway 78*p* in the second core plug 78 to form a loop 82. The second core plug 78 is rotatable within the side wall opening 39 and serves as an adjustment device for adjusting rotational resistance of the roll 50. The second core plug 78 includes an externally accessible exposed end portion 79 that is configured to be gripped by a user such that the user can rotate the second core plug 78. The loop 82 is configured to twist and cause the first and second core plugs 76, 78 to move towards each other, thereby causing the first support member 72 to exert a compressive force on the first end 50*a* of the roll 50 and the second support member 74 to exert a compressive force on the second end 50*b* of the roll 50 in response to user rotation of the second core plug 78. Clockwise rotation of the second core plug 78 will cause the first and second support members 72, 74 to exert a compressive force on the first and second ends 50*a*, 50*b* of the roll 50 to increase rotational resistance. Counterclockwise rotation of the second core plug 78 will reduce the compressive force of the first and second support members 72, 74 to decrease rotational resistance.

It is noted, however, that continuous rotation in either the clockwise direction or the counterclockwise direction will increase the compressive force and increase rotational resistance. Rotation that causes the loop 82 to return to a neutral, untwisted state will reduce the compressive force of the support members 72, 74 and decrease rotational resistance. Thus, if the second core plug 78 is initially rotated in the counterclockwise direction, such rotation will cause the first and second support members 72, 74 to exert a compressive force on the first and second ends 50*a*, 50*b* of the roll 50 to increase rotational resistance. Clockwise rotation of the second core plug 78 will reduce the compressive force of the first and second support members 72, 74 to decrease rotational resistance.

In other embodiments of the present invention, the cord 80 may be replaced by a rod (not shown) that extends through the hollow core 50*c*. One end of the rod may be secured to the first core plug 76 and the opposite end may be threadingly secured to the second core plug 78. Rotation of the second core plug 78 causes the first and second core plugs 76, 78 to move towards each other, as described above. For example, clockwise rotation of the second core plug 78 will cause the first support member 72 to exert a compressive force on the first end 50*a* of the roll 50 and the second support member 74 to exert a compressive force on the second end 50*b* of the roll 50, thereby increasing rotational resistance of the roll 50. Similarly, counterclockwise rotation of the second core plug 78 will reduce the compressive force of the first and second support members 72, 74 to decrease rotational resistance.

Figure 12:
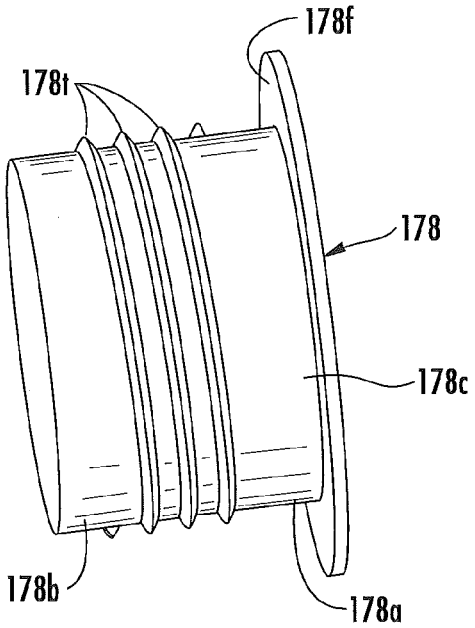
FIG. 12 is a perspective view of a core plug for adjusting rotational resistance of the roll of expandable material, according to some embodiments of the present invention.

In other embodiments of the present invention, the second core plug 78 and the cord 80 can be replaced by a threaded core plug 178 (FIG. 12) that is utilized to apply a compressive force on the second end 50*b* of the roll 50 of expandable sheet material 52. As illustrated in FIG. 12, the threaded core plug 178 includes opposite first and second end portions 178*a*, 178*b*, and a radially outwardly directed flange 178*f* positioned adjacent the first end portion 178*a*. The threaded core plug 178 includes a generally cylindrical intermediate portion 178*c* between the first and second end portions 178*a*, 178*b*. Threads 178*t* on the intermediate portion 178*c* are configured to engage the hollow core 50*c* of roll 50 and urge the roll 50 towards the second support member 74 to exert a compressive force on the second end of the roll 50 in response to user rotation of the threaded core plug 178. With the illustrated configuration of the threads 178*t*, clockwise rotation of the threaded core plug 178 will urge the roll 50 towards the second support member 74 to increase rotational resistance and counterclockwise rotation of the threaded core plug 178 will move the roll 50 away from the second support member 74 to decrease rotational resistance.

Figure 10A:
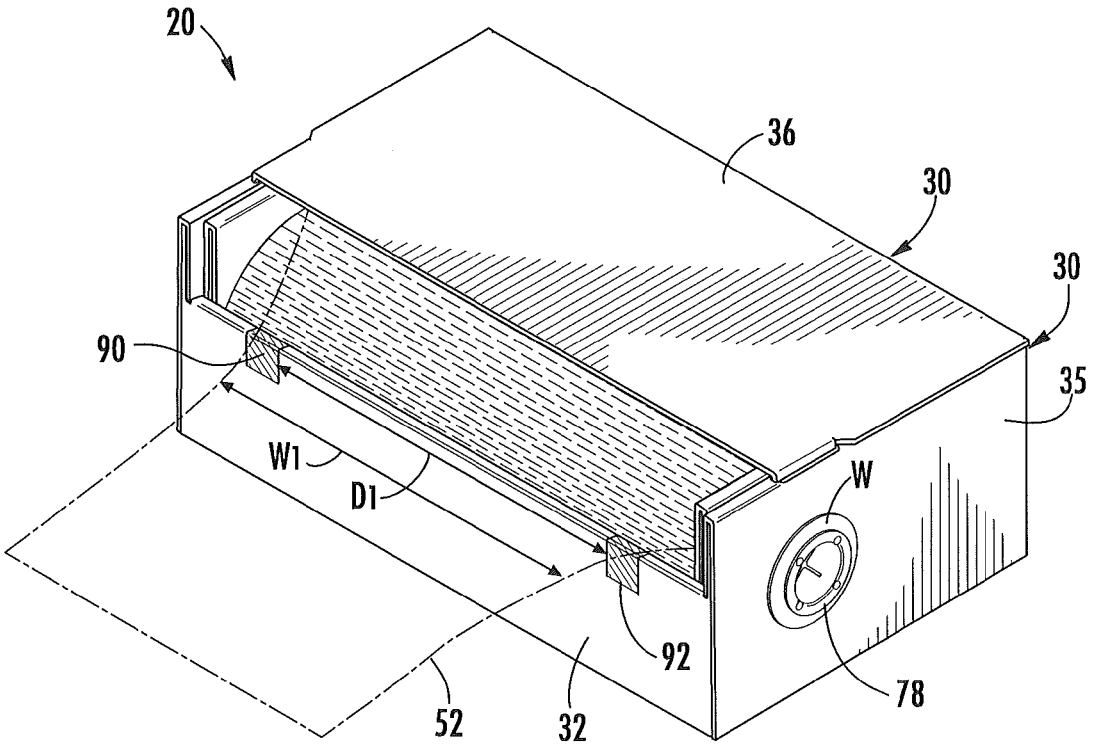
FIG. 10A is a top, front perspective view of the apparatus of FIG. 2 illustrating visual indicia for use in determining if the expandable material is in a proper expanded form, according to some embodiments of the present invention.

Referring now to FIG. 7, when a user pulls the expandable sheet material 52 from the box 30, and there is rotational resistance on the roll 50, the expandable sheet material 52 stretches and thereby expands in length and thickness as the slits 53 in the material 52 open up to form an array of openings 53*a*, such as hexagonal openings. The width of the material 52 in an expanded form is less than a width of the unexpanded material, as illustrated in FIG. 7. To facilitate expansion of the material 52 to a proper expanded form, visual guides may be provided to indicate the proper width of the material in an expanded form. For example, as illustrated in FIG. 10A, in some embodiments of the present invention, the box 30 includes spaced-apart first and second visual indicia 90, 92 on the front wall 32 of the box 30 adjacent the dispensing opening 38. A distance $D_1$ between the first and second visual indicia 90, 92 corresponds to a desired width $W_1$ of the expandable sheet material 52 as it is pulled from the box 30 in a proper expanded shape. If the width of the expandable sheet material 52 as it is pulled from the box 30 is greater than $W_1$, then the material 52 is not in proper expanded form. Additional rotational resistance to the roll 50 is necessary to reduce the width to $W_1$, and this is accomplished via clockwise rotation of the second core plug 78 or 178, as described above. If the material 52 tears as it is being pulled from the box 30, then too much rotational resistance has been applied to the roll 50. The rotational resistance is lessened by counterclockwise rotation of the second core plug 78 or 178, as described above.

Also, as described above, rotational resistance to the roll 50 can be accomplished by initially rotating the second core plug 78, 178 in either the clockwise or counterclockwise directions. Continuous rotation in either clockwise or counterclockwise directions will increase the compressive force and increase rotational resistance. Rotation that causes loop to return to a neutral untwisted state will reduce the compressive force of the support members and decrease rotational resistance.

Figure 10B:
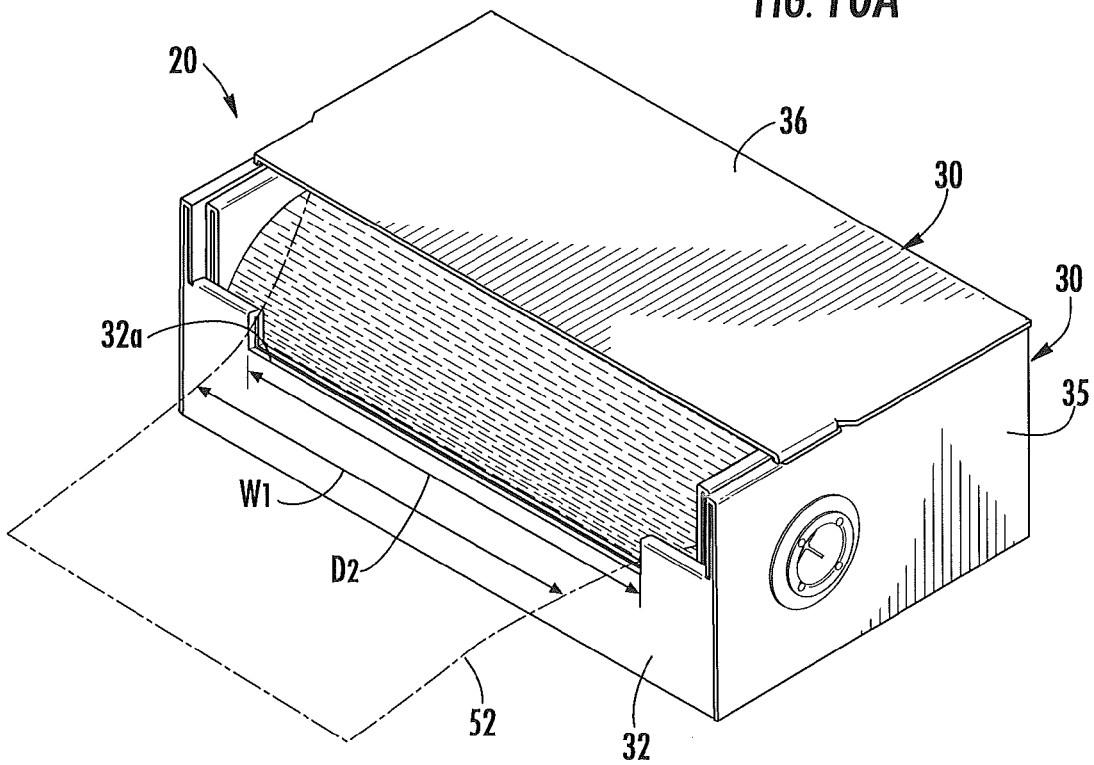
FIG. 10B is a top, front perspective of the apparatus of FIG. 2 illustrating a recessed edge portion on a front wall of the apparatus for use in determining if the expandable material is in a proper expanded form, according to some embodiments of the present invention.

In other embodiments of the present invention, as illustrated in FIG. 10B, in lieu of or with visual indicia, an edge portion 32*a* of the front wall 32 can be utilized to facilitate proper rotational resistance. In the illustrated embodiment, the front wall 32 includes a recessed edge portion 32*a* below the dispensing opening 38. The recessed edge portion 32*a* has a lateral width $D_2$ that corresponds to a desired width $W_1$ of the expandable sheet material 52 as it is pulled from the box 30 in a proper expanded shape. The material 52 in the proper expanded form will have a width $W_1$ that will fit within the recessed edge portion 32*a*. If the width of the expandable sheet material 52 as it is pulled from the box 30 is greater than $W_1$, then the material is not in proper expanded form. Additional rotational resistance to the roll 50 is necessary to reduce the width to $W_1$, and this is accomplished via clockwise rotation of the second core plug 78, 178 as described above.

The amount of rotational resistance necessary to cause the expandable material 52 to expand to a proper form depends on the type of material. For example, heavier weight kraft paper typically will require more rotational resistance to expand than a lighter weight kraft paper. In addition, embodiments of the present invention are not limited to dispensing expandable packing material. Other packing materials may be dispensed from the box 30 including, but not limited to, bubble wrap, tape, stretch wrap film, etc.

Referring to FIG. 8, the cushioning wrap material 54 includes the combination of the interleaf material 42 and expandable sheet material 52 in its expanded form. A user manually pulls the interleaf material 42 and expandable sheet material 52 concurrently from the box 30 in abutting contact, and wraps an article (not shown) with the cushioning wrap material 54. When sufficient cushioning wrap material 54 is dispensed, a user can tear the interleaf material 42 and expandable sheet material 52 by hand.

Figure 15:
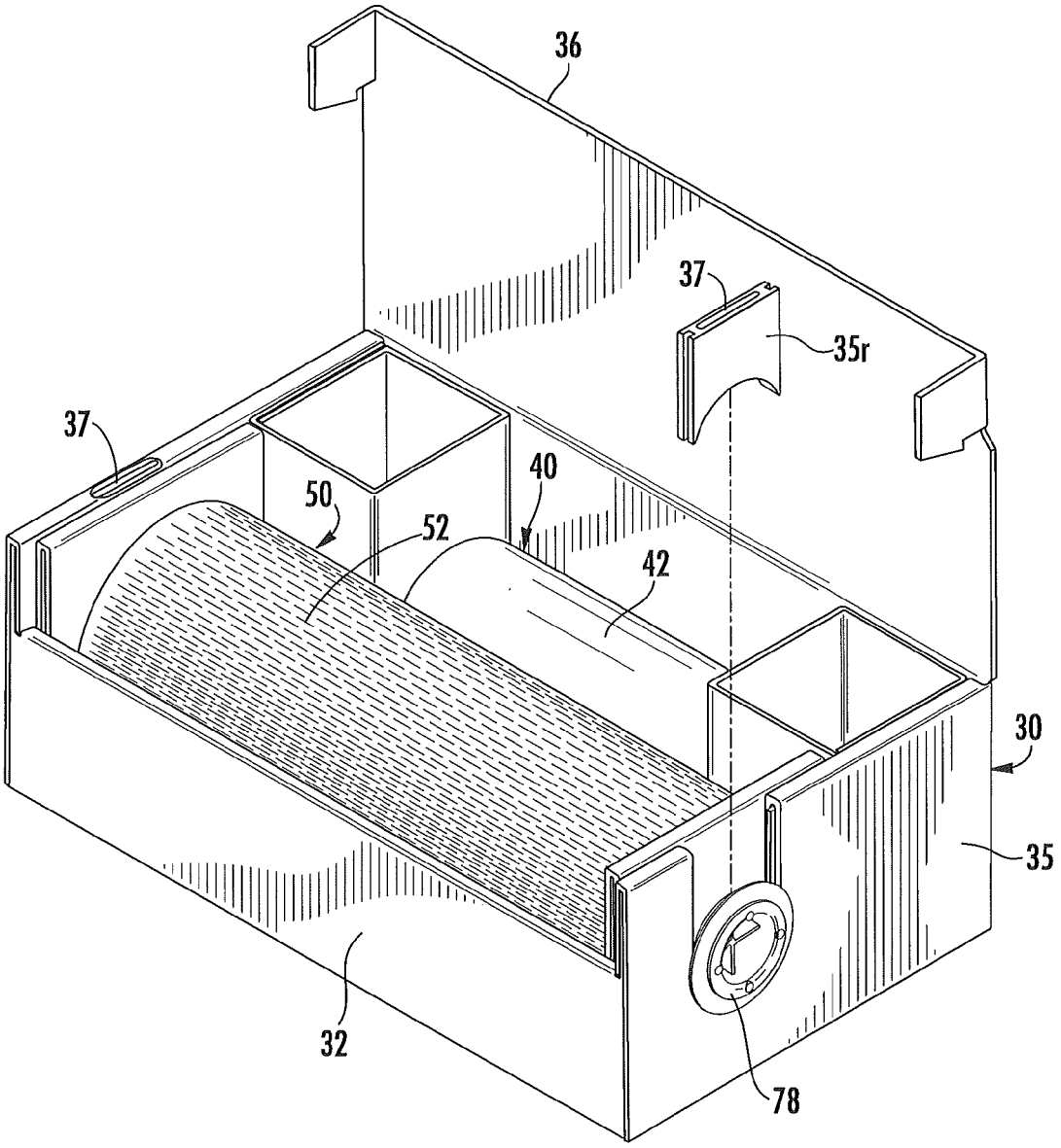
FIG. 15 is a top, front perspective view of a dispensing apparatus, according to other embodiments of the present invention.

The box 30 may be reused numerous times by replacing depleted rolls 40, 50 of interleaf material 42 and expandable sheet material 52 with new rolls. In some embodiments of the present invention, the box 30 may be configured to facilitate quick replacement of the roll 50 of expandable sheet material 52. For example, as illustrated in FIG. 15, the side wall 35 includes a removable portion 35*r* that can be separated from the wall to facilitate replacement of the roll 50 of expandable sheet material 52 and tension assembly 70 as a unit. For example, when the removable portion 35*r* is separated from the side wall 35, the roll 50 and tension assembly 70 can be lifted out of the box 30 without having to remove the first and second core plugs 76, 78 and/or the cord 80 connecting the first and second core plugs 76, 78.

Figure 16A:
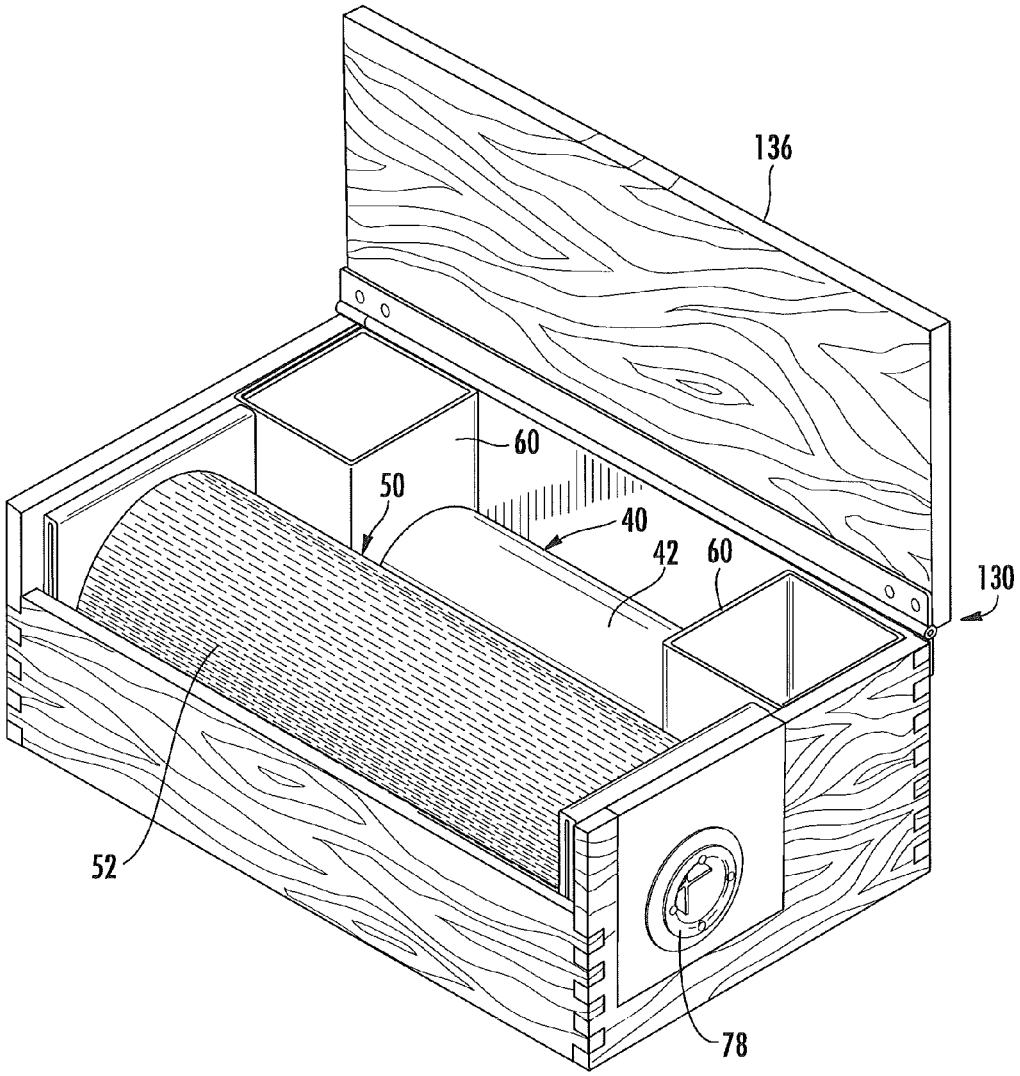
FIGS. 16A and 16B are top, front perspective views of a dispensing apparatus, according to other embodiments of the present invention.
Figure 16B:
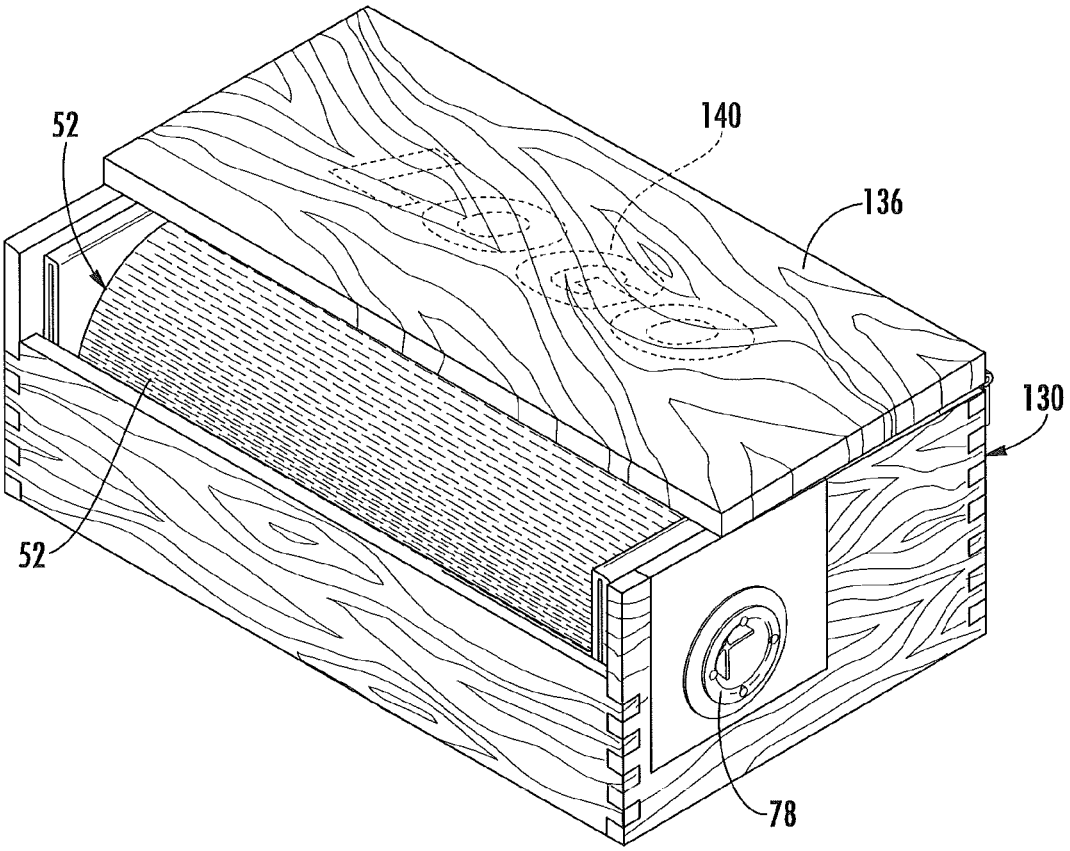

In other embodiments of the present invention, the box 30 may be made from more durable and/or decorative materials, such as wood and/or metal. Corporate logos and/or other designs can be added to provide an aesthetically pleasing apparatus. For example, FIGS. 16A-16B illustrate a wooden box 130 in which the roll 40 of interleaf material 42 and roll 50 of expandable sheet material 52 are located. The box 130 includes a logo or other decorative design 140 on the movable cover 136. The box 130 is intended to be reused. As such, replacement rolls 40, 50 can be provided and inserted within the box 130. For example, a roll 50 of expandable sheet material 52 and tension assembly 70 can be provided as a unit that can be replaced within the box 130.

In other embodiments of the present invention, kits of pre-packaged replacement components can be provided, including, but not limited to rolls 40 and 50. Moreover, rolls 40, 50 of different length materials 42, 52 and/or different color materials 42, 52 can also be provided.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An apparatus for dispensing material, the apparatus comprising:

a box comprising a dispensing opening in communication with an interior of the box;

a roll of interleaf material rotatably positioned within the box such that a free end of the interleaf material can extend through the dispensing opening;

a roll of expandable sheet material in an unexpanded form rotatably positioned within the box adjacent the first roll of sheet material such that a free end of the expandable sheet material can extend through the dispensing opening; and a tensioning assembly operably associated with the roll of expandable sheet material to control rotational resistance thereof;

wherein the interleaf material and expandable sheet material can be concurrently manually pulled out of the box in abutting contact;

wherein the rotational resistance of the roll of expandable sheet material causes the expandable sheet material to expand in thickness and length as it is pulled with the interleaf material from the box; and wherein the rotational resistance is adjustable by a user to obtain a proper expanded form of the expandable sheet material.

2. The apparatus of claim 1, wherein the box comprises a cover that is movable between open and closed positions, and wherein the dispensing opening resides above a front wall of the box when the cover is in the closed position.

3. The apparatus of claim 1, wherein the tensioning assembly comprises an adjustment mechanism that resides in an external sidewall of the box to allow a user to control rotational resistance of the roll of expandable sheet material.

4. The apparatus of claim 1, wherein each roll has a width with a centerline, wherein the rolls are located within the box such that the respective centerlines of the rolls are substantially aligned, and wherein axial directions of the rolls are substantially parallel to each other and to front and rear walls of the box.

5. The apparatus of claim 1, wherein a width of the roll of interleaf material is the same or less than a width of the roll of expandable sheet material.

6. The apparatus of claim 1, wherein the expandable sheet material comprises paper with a slit pattern that forms an array of openings when the expandable sheet material is in its expanded form, and wherein the interleaf material is tissue paper.

7. The apparatus of claim 1, wherein the box comprises spaced-apart first and second visual indicia adjacent the dispensing opening, wherein a distance between the first and second visual indicia corresponds to a desired width of the expandable sheet material as it is dispensed from the box in a proper expanded shape.

8. The apparatus of claim 1, wherein the box comprises a forward wall with a recessed edge portion below the dispensing opening, the recessed edge portion having a lateral width that corresponds to a desired width of the expandable sheet material as it is dispensed from the box in a proper expanded shape.

9. The apparatus of claim 1, wherein the box comprises opposite front and rear walls, wherein the roll of interleaf material is positioned within the box adjacent the rear wall and the roll of expandable sheet material is positioned within the box adjacent the front wall.

10. The apparatus of claim 1, wherein the box comprises opposite front and rear walls, wherein the roll of interleaf material is positioned within the box adjacent the front wall and the roll of expandable sheet material is positioned within the box adjacent the rear wall.

11. The apparatus of claim 1, wherein the box comprises opposite side walls, wherein the roll of interleaf material comprises opposite end portions, and wherein a spacer is positioned between each end portion and a respective side wall such that the roll of interleaf material is centered laterally in the box between the opposite side walls relative to the roll of expandable sheet material.

12. The apparatus of claim 11, wherein the roll of interleaf material comprises an axially-extending hollow core, wherein an elongated member having opposite end portions extends through the hollow core, and wherein each end portion of the elongated member is suspended by a respective one of the spacers.

13. The apparatus of claim 1, wherein the roll of expandable sheet material comprises an axially-extending hollow core, and wherein the tension assembly comprises:

first and second support members, each having an opening formed therethrough, the first support member proximate a first end of the roll of expandable sheet material, and the second support member proximate an opposing second end of the roll of expandable material;

a first core plug that extends through the first support member opening and into one end of the hollow core;

a second core plug that extends through an opening in a side wall of the housing, through the second support member opening, and into an opposite end of the hollow core; and a cord extending though the hollow core and secured to the first and second core plugs to form a loop, wherein the loop is configured to twist and cause the first support member to exert a compressive force on the first end of the roll of expandable sheet material in response to user rotation of the second core plug.

14. The apparatus of claim 1, wherein the roll of expandable sheet material comprises an axially-extending hollow core, and wherein the tension assembly comprises:

first and second support members, each having an opening formed therethrough;

a first core plug, comprising:

opposite first and second end portions;

a radially outwardly directed flange adjacent the first core plug first end portion; and first and second passageways formed through the first core plug from the first end to the second end thereof;

wherein the first core plug second end portion extends through the first support member opening and into one end of the hollow core such that the first support member is positioned between a first end of the roll of expandable sheet material and the first core plug flange;

a second core plug, comprising:

opposite first and second end portions;

a radially outwardly directed flange adjacent the second core plug first end portion; and a third passageway formed through the second core plug;

wherein the second core plug second end portion extends through an opening in a side wall of the housing, through the second support member opening, and into an opposite end of the hollow core such that the second support member is positioned between an opposite second end of the roll of expandable sheet material and the housing side wall; and a cord extending though the hollow core section, and through the first, second, and third passageways to form a loop, wherein the loop is configured to twist and cause the first support member to exert a compressive force on the first end of the roll of expandable sheet material in response to user rotation of the second core plug.

15. The apparatus of claim 1, wherein the roll of expandable sheet material comprises an axially-extending hollow core, and wherein the tension assembly comprises:

first and second support members, each having an opening formed therethrough, the first support member proximate a first end of the roll of expandable sheet material, and the second support member proximate an opposing second end of the roll of expandable material;

a first core plug that extends through the first support member opening and into one end of the hollow core; and a second core plug that extends through an opening in a side wall of the housing, through the second support member opening, and into an opposite end of the hollow core, wherein the second core plug comprises an externally-threaded portion;

wherein, in response to user rotation of the second core plug, the externally-threaded portion urges the roll of expandable material towards the second support member to exert a compressive force on the second end of the roll of expandable sheet material.

16. The apparatus of claim 1, wherein the roll of expandable sheet material comprises an axially-extending hollow core, and wherein the tension assembly comprises:

first and second support members, each having an opening formed therethrough;

a first core plug, comprising:

opposite first and second end portions; and a radially outwardly directed flange adjacent the first core plug first end portion;

wherein the first core plug second end portion extends through the first support member opening and into one end of the hollow core such that the first support member is positioned between a first end of the roll of expandable sheet material and the first core plug flange; and a second core plug, comprising:

opposite first and second end portions; and a radially outwardly directed flange adjacent the second core plug first end portion;

wherein the second core plug second end portion comprises an externally-threaded portion;

wherein the second core plug second end portion extends through an opening in a side wall of the housing, through the second support member opening, and into an opposite end of the hollow core such that the second support member is positioned between an opposite second end of the roll of expandable sheet material and the housing side wall; and wherein, in response to user rotation of the second core plug, the externally-threaded portion urges the second roll of expandable towards the second support member to exert a compressive force on the second end of the roll of expandable sheet material.

17. The apparatus of claim 1, wherein the box is a cardboard box.

18. The apparatus of claim 1, wherein the box is configured to allow the roll of expandable sheet material and the tensioning assembly to be inserted and removed as a unit.

19. An apparatus for dispensing material, the apparatus comprising:

a box comprising a dispensing opening in communication with an interior of the box;

a roll of interleaf material rotatably positioned within the box such that a free end of the interleaf material can extend through the dispensing opening;

a roll of expandable sheet material in an unexpanded form rotatably positioned within the box adjacent the first roll of sheet material such that a free end of the expandable sheet material can extend through the dispensing opening, wherein the interleaf material and expandable sheet material can be concurrently manually pulled out of the box in abutting contact; and a tensioning assembly the tensioning assembly having first and second support members bounding opposite axial ends of the roll of expandable sheet material, and having an adjustable member extending between the first and second support members, where the adjustment of the adjustable member by a user allows control of rotational resistance of the roll of expandable sheet material to obtain a proper expanded form of the expandable sheet material as it is pulled with the interleaf material from the box through the dispensing opening.

20. The apparatus of claim 19, wherein the adjustable member is a cord configured to be twisted by a user to cause the support members to exert a compressive force between the opposite axial ends of the roll of expandable sheet material in response to user rotation of the cord.

* * * * *